United States Patent [19]

Ballentine

[11] 4,135,875

[45] Jan. 23, 1979

[54] APPARATUS FOR BURNING GASEOUS FUEL

[76] Inventor: Earle W. Ballentine, 3641 Via Palomina Str., Palos Verdes Estates, Calif. 90274

[21] Appl. No.: 796,424

[22] Filed: May 12, 1977

Related U.S. Application Data

[63] Continuation-in-part of Ser. No. 727,578, Sep. 28, 1976, abandoned, which is a continuation-in-part of Ser. No. 419,514, Nov. 28, 1973, abandoned, and Ser. No. 687,663, May 19, 1976, abandoned, said Ser. No. 419,514, is a continuation-in-part of Ser. No. 376,405, Jul. 5, 1973, abandoned, which is a continuation-in-part of Ser. No. 250,589, May 5, 1972, abandoned, said Ser. No. 687,663, continuation-in-part of Ser. No. 610,564, is a continuation-in-part of Ser. No. 512,524, Nov. 7, 1974, abandoned, which is a continuation-in-part of Ser. No. 327,148, Jan. 26, 1973, abandoned.

[51] Int. Cl.[2] ..... F23D 13/40

[52] U.S. Cl. ..... 431/354; 239/557; 239/558

[58] Field of Search ..... 126/41 R, 39 R, 354; 239/548, 557, 552, 556, 558

[56] References Cited

U.S. PATENT DOCUMENTS

| | | | |
|---|---|---|---|
| 2,103,365 | 12/1937 | Hess | 239/548 |
| 3,476,321 | 11/1969 | Levaux | 239/557 X |
| 3,563,473 | 2/1971 | Ferroli | 239/557 |

*Primary Examiner*—Edward G. Favors

*Attorney, Agent, or Firm*—Smyth, Pavitt, Siegemund, Jones & Martella

[57] ABSTRACT

A device for burning gaseous fuels in which the stoichiometric quantity of air for complete combustion is mixed with the fuel gas by entrainment. The fuel gas is discharged through openings arranged in a two dimensional array and the openings are so spaced from each other that the turbulent jets merge in a plane in which just the right amount of air has been entrained into the jets by turbulence.

14 Claims, 19 Drawing Figures

FREE TURBULENT JET $h = 0.016\rho V_0 \delta_0$ ---------- I $Q/Q_0 = 0.28 Z/\delta_0$ ---------- II $(\bar{V}_Z)_{MAX}/V_0 = 6.4 d_0/Z$ ---------- III $\bar{V}_Z/(\bar{V}_Z)_{MAX} = [1 + r^2/0.016 Z^2]^{-2}$ --- IV

TURBULENT JET GEOMETRY

RADIAL FLOW DISTRIBUTION
FREE TURBULENT JET

QUADRIFORM ARRAY $D_s = 2.42\ R d_o$

OCTOFORM ARRAY $D_5 = 2.42\ Rd_0$

DELTAFORM APERTURE ARRAY

HEXTOR BURNER $D_S = 2.42 R d_0$

APPARATUS FOR BURNING GASEOUS FUEL

This is a continuation-in-part of my application Ser. No. 727,578 filed Sept. 28, 1976, which in turn is a continuation-in-part of applications Ser. No. 419,514, filed Nov. 28, 1973, and Ser. No. 687,663, filed May 19, 1976. Ser. No. 419,514 is a continuation-in-part application of application Ser. No. 376,405, filed July 5, 1973, which is a continuation-in-part of application Ser. No. 250,589, filed May 5, 1972, now abandoned; Ser. No. 687,663 is a continuation-in-part of my application Ser. No. 610,564, filed Sept. 4, 1975, which is a continuation-in-part of my application Ser. No. 512,524, filed Nov. 7, 1974, which is a continuation-in-part application of Ser. No. 327,148, filed Jan. 26, 1973 all abandoned.

BACKGROUND OF THE INVENTION

This invention relates to apparatus for burning gaseous fuel.

The modern domestic gas burner has evolved from the discoveries of three men.

Robert Wilhelm Bunsen, a German chemist, invented the first high temperature blue flame burner in 1855 which is still in use in laboratories. The basic principle of a jet of gas entraining air in a tube open at both ends has its counterparts in all gas burners with the exception of the jet and target burners.

Sir Humphrey Davy, an English chemist, discovered that a gas flame would not pass through a wire screen providing the spacing between the wires was less than a specific size. This discovery led to his invention of the miner's safety lamp before 1819. This phenomenon is the basis of all burners which have burner heads with many small ports. Some laboratory burners still use a wire mesh for preventing the flame to flash back to the gas nozzle orifice. Flashback will always occur with burner ports which are larger than the Davy critical size whenever the efflux velocity of the air-gas mixture has a magnitude that is less than the burner velocity of the gas. This phenomenon can also occur if the temperature of the ports reaches a sufficiently high value that they raise the air-gas mixture temperature. The burning velocity of the air-gas mixture increases with the temperature and the result can be a flashback. The flashback tendencies become minimal when the depth of the ports is ⅜" or more. Likewise, means for cooling the ports reduces the flashback tendencies. The ports, however, which are of small diameter introduce a resistance to the flow of the air-gas mixture. This resistance if the flow is laminar increases inversely with the fourth power of the port diameter. The effect of this port head loss is to reduce the capacity of the burner. All of the energy for entraining and mixing the air with the gas must be intrinsic to the jet of gas at the nozzle orifice exit. Although the method of mixing the gas in a straight tube as originated by Bunsen is still used today in some commercial gas burners, there is a superior method for mixing air and gas as follows.

Giovanni Batista Venturi was an Italian physicist who invented, before 1822, a device which is named after him, that is, a Venturi tube. This well-known device is used for measuring fluid flow, as an ejector, etc.,; is in effect a nozzle upstream from the throat and a diffuser downstream from the throat. A superior burner is thus obtained by replacing the Bunsen tube with the Venturi throat and diffuser. A portion of the velocity head of the air-gas mixture entering the burner throat is transformed into static pressure in accordance with the Bernouli equation. This static pressure thus compensates for the resistance to flow of the gas ports with the result that the burner capacity is increased accordingly.

The highest performance obtained by a gas burner embodying the above components is the laboratory Meker burner in which all of the air for complete combustion is mixed with the gaseous fuel before the air-gas mixture leaves the burner port. Such a burner is variously called a stoichiometric burner, a fully aerated burner or a burner with 100% primary air. In addition to the highest flame temperature, the gas products can impinge on a cold surface without producing carbon monoxide because the combustion is complete at the tips of cones at the flame base. However, such a burner has a very limited output capacity. There are no fully aerated domestic gas burners in existence and the reasons for their nonexistence will be explained later.

All domestic gas burners use primary and secondary air, including jet and target gas burners. The Bunsen-Venturi gas burners use primary air ratios of about 30% to 60%. The range top burners have the higher primary aerations and the ovens use the lower aerations with heat outputs of 9000–12000 BTU/hr for the former and 18000–24000 BTU/hr for the latter. Water heaters use about 30000 BTU/hr and some of the burners are of the jet and target type. My calculated aerations for the latter type indicate that the primary aerations are less than 60% as determined by the jet orifice diameter and the distance between the jet and the target.

These partially aerated gas burners have many disadvantages including much lower flame temperature, the inability of the flames to impinge on cold surfaces without carbon monoxide formation, large combustion space for secondary aeration, and so forth.

DESCRIPTION OF THE INVENTION

All of these disadvantages are obviated by my development of a new principle or method of burning gas by the application of theoretical analysis. (The probability of discovering this new phenomenon by cut and try experimentation is almost negligible and it is probable that this is the reason that my new phenomenon was not discovered during the last 100 years.) My analysis of the performance of fully aerated Bunsen-Venturi burners using the Bureau of Standards and American Gas Association theoretical and empirical equations, was that it was not possible for a signle turbulent jet to entrain 100% of the air for combustion and move the air-gas mixture through the bell-mouth entrance, diffuser and burner head ports and obtain a performance with any economic value outside of laboratory use. My solution of the problem was to eliminate all structure for mixing the air and gas and for obtaining the exact air-gas ratio required. Accordingly, I suggest to provide a two dimensional array of apertures in a burner chamber which receives the fuel gas; the apertures emit free turbulent jets which are so spaced that they coalesce after having entrained the stoichiometrically necessary quantity of air. My new principles will best be understood by following the various steps which I used in arriving at a theoretical design. Although the performance of my first model was good, two later models were quite superior. Whereas prior art stoichiometric burners have a heat output of about ten thousand BTU/hr, my burner can be built with an output of hundreds of thousands BTU/hr.

DESCRIPTION OF THE DRAWINGS

While the specification concludes with claims pointing out and distinctly claiming the subject-matter which is regarded as the invention, it is believed that the invention, its objects and features, and advantages thereof will be better understood from the following description, which merely illustrates exemplary preferred embodiments of structure which may be utilized to practice the invention taken in connection with the accompanying drawings, in which:

The Bureau of Standards and the American Gas Association have made extensive theoretical and empirical studies for the design of contemporary gas burners. The A.G.A. empirical equations for the design of Bunsen-Venturi type burners are undoubtedly the accepted technology for this most common type of domestic gas burner. Their equation contains an additional four parametric functions which evaluate open tube injection of air, injection with a burner head, the effect of port diameter and depth, the effect of port temperature. The A.G.A. equation is as follows:

$$Q_g\,0.45 = K\,F_R\,F_P\,P_O/0.775\,(R + 1)$$

where $Q_g$ = gas flow rate

K = open tube injection

= function of the throat diameter $D_t$ $F_R$ = effect of throat to port area ratios $F_P$ = effect of port diameter and depth $F_O$ = effect of port temperature R = air-gas ratio On the basis of a study of these parameters, I have chosen the following values for the parametric functions and the air-gas ratio:

$F_R = 0.76$, $F_P = 0.88$, $F_O = 1.00$

R = 10 for 100% primary air for natural gas

The reason that $F_O = 1.00$ is due to the fact that with a fully aerated burner in which natural gas is only 1/11 of the mixture there is a very low efflux velocity which in combination with the high burning velocity of a stoichiometric mixture requires the very small openings used by Sir Humphrey Davy in his miners' safety lamp. This opening, according to A.G.A., must have a diameter less than 0.131 inch for methane + 100% air. The Fischer Meker type fully aerated burner uses an opening 0.080 × 0.080" square by ⅜" deep with natural gas and manufactured gas.

Figure 1:
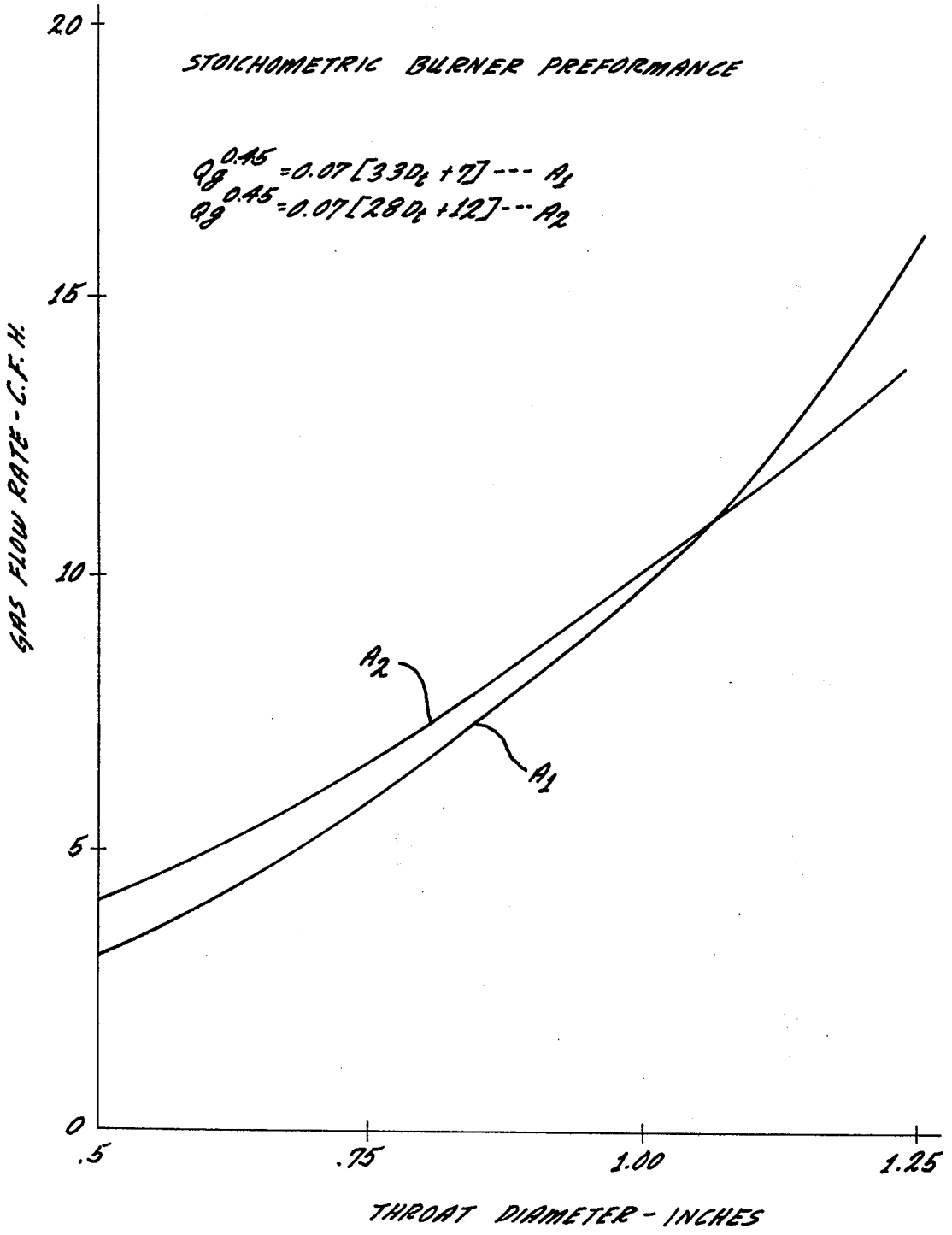
FIG. 1 presents two curves which are representative of the prior art stoichiometric burner.

FIG. 1 shows a first curve A1 which is the preferred design of the A.G.A., the diffuser slope is 2°. The equation for the 2° slope diffuser is $Qg^{0.45} = 0.07\,(33\,D_T + 7)$. The righthand side of this equation is a straight line in the slope-intercept form. The Fischer diffuser has a slope which is a little over 4°, and the throat is 0.75" The Fischer burner has a gas flow rate of 6.4 CF hr. From these three parameters the calculated performance equation is $Qg^{0.45} = 0.07\,(28\,D_T + 12)$. The heat output with natural gas with the heat value of 1050 BTU/ft$^3$ is, therefore, about 6700 BTU/hr. The Fischer burner has a claimed output of over 10,000 BTU/hr. at usual pressures which are not stated. The curve A2 gives the performance of the Fischer burner which has a much shorter height with a 4° slope than a burner with a 2° slope and the performance is better. I have not found any fully aerated laboratory burners with throat diameters as large as 1".

Figure 2:
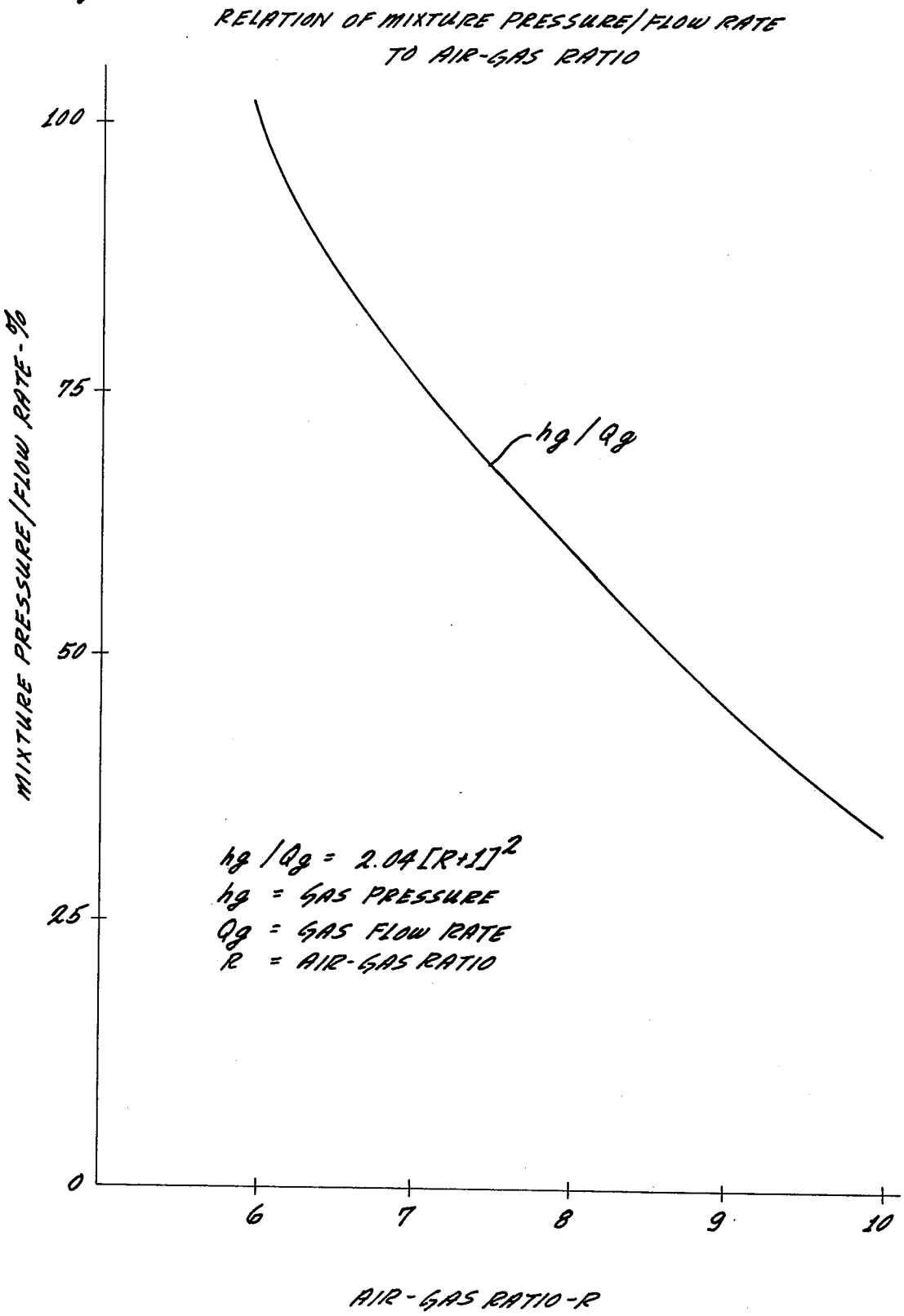
FIG. 2 relates the ratio of the mixture pressure to flow rate as a function of the air-gas ratio.
Figure 3:
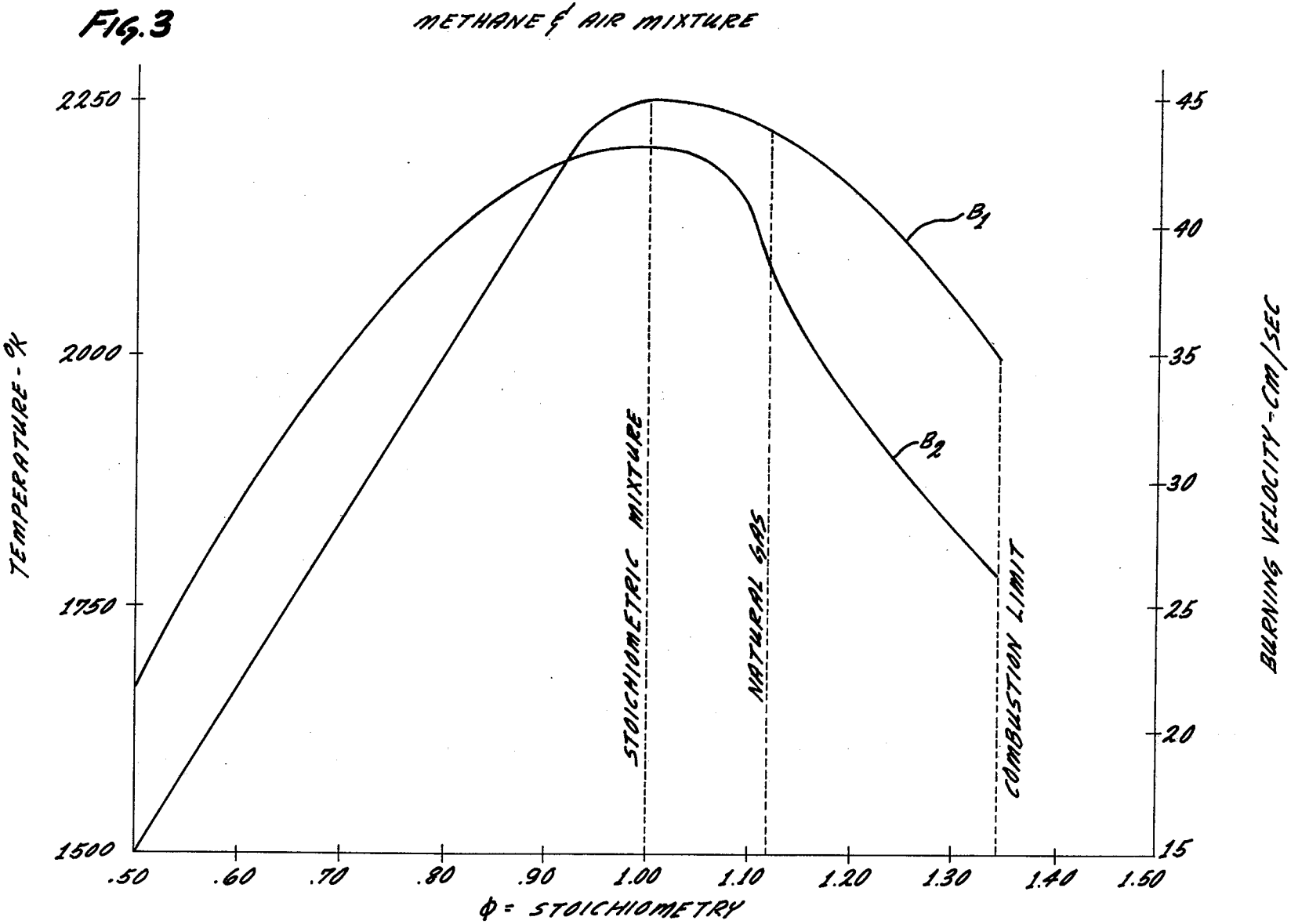
FIG. 3 shows two curves giving the temperature and burning velocity of a gas burner as a function of the primary aeration.

The air-gas ratio used in contemporary Bunsen-Venturi type burners rarely exceeds 6 to 1. If the orifice diameter is reduced in a specific burner which was designed for 60% primary aeration, the primary air increases. This increased quantity of air must be forced through the same structure with a smaller gas pressure. This is a vicious cycle. The important consideration would be the ratio of the mixture pressure to the mixture flow rate. I derived a simple expression for the effect of increasing the primary aeration from 60% to 100%, which is shown in FIG. 2. This graph shows that the ratio of the gas pressure to the flow rate for 100% primary air which is required for complete combustion is only 41% of the corresponding ratio for 60% aeration. There are several disadvantages to using primary aeration in the 30 to 60% range. In order to get blue flame operation it is necessary to divide the primary mixture into a large number of small jets with sufficient space between them to entrain the quantity of secondary air required. This extended flame is mixed with the contiguous air and this dilution lowers the temperature of the gases. The temperature of these gases from a range top burner are about 1650° F. according to the A.G.A. Thus, the combustion chamber required is much larger than if the burner was totally aerated. Natural gas is a slow burning gas, but when all the air from combustion is mixed with the gas, the burning velocity is much faster. FIG. 3 shows the large increase in flame temperature with primary aeration of 100% and the substantial increase in burning velocity at this stoichiometric aeration.

Curve B1 gives the theoretical flame temperature for the combustion of methane in air for primary aerations ranging from 50% to 134%. The flame temperature for 110% primary air is almost as high as the stoichiometric aeration of 100%. Thus, the word stoichiometric will mean 100% aeration or more unless stated otherwise. By increasing the aeration to 135%, the combustion temperature is lowered about 450° F. The oxides of nitrogen are components of smog and the quantity of oxide produced increases with the combustion temperature. Under certain conditions, it might be advantageous to use primary aerations of more than 100%. Curve B2 shows that the burning velocity increases from 23 in/sec. to 46 in/sec. when the primary aeration goes from 50% to 100%. Thus, the reaction velocity doubles with the result that a correspondingly shorter distance of travel will means a likewise much smaller combustion space.

Figure 4:
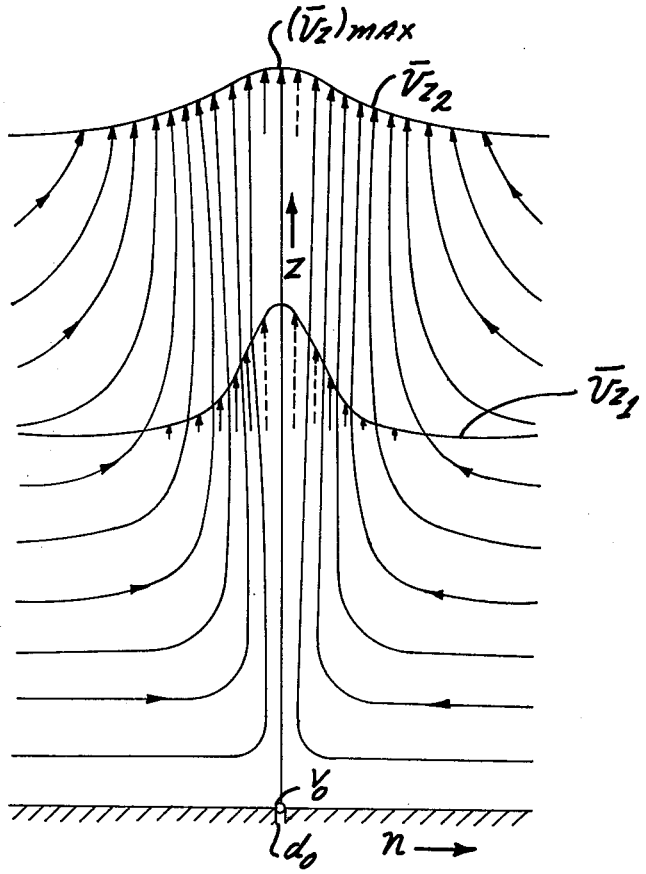
FIG. 4 illustrates schematically the flow field of a free turbulent jet.
Figure 8:
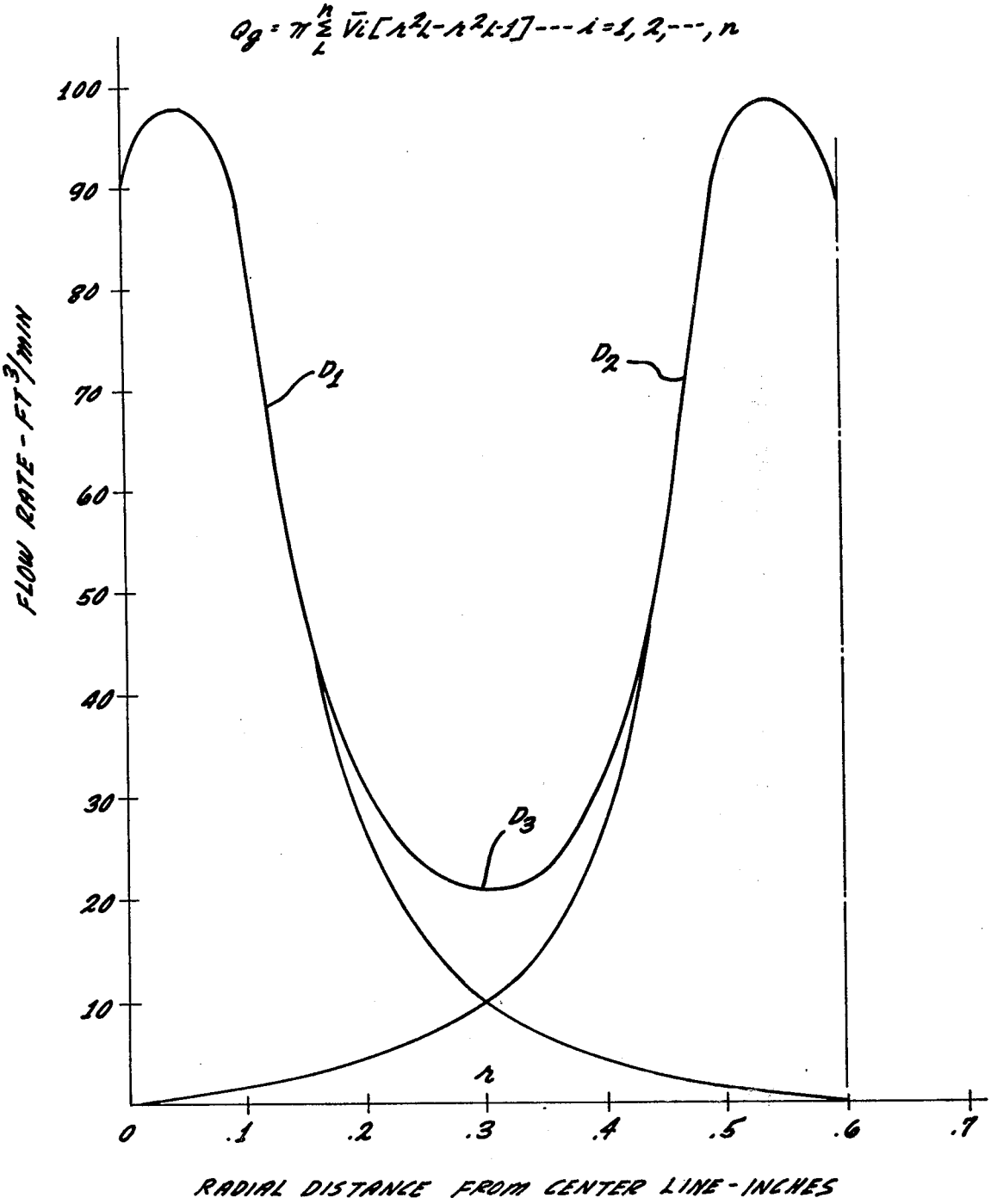
FIG. 8 is a graph of the radial flow distribution of the jet which is the subject of FIG. 7.

The free turbulent jet is the core of my new method for the stoichiometric combustion of gaseous fuel and a thorough understanding of the principles of this unique phenomenon is the essence of my burner theory. FIG. 4 provides both a graphical representation of the flow field of a free turbulent jet and the analytic expressions for some of its salient characteristics. The origin of a free turbulent jet is a primary fluid which emanates from an aperture having a diameter $d_o$ and having a velocity $V_o$ at the aperture. This primary fluid discharges into an initially stationary secondary fluid and the axis of the primary fluid is designated Z. The primary fluid entrains the secondary fluid which flows radially towards the Z axis. The volume of secondary fluid increases linearly with distance along the Z axis. The flow rate of the primary fluid is designated Qo, and the flow rate of the entrained secondary fluid is Q. Thus, the ratio Q/Qo is identical to the air-gas ratio R. Equation II of FIG. 4 shows that the air-gas ratio is a linear function of the distance traveled along the Z axis and the air-gas ratio also increases inversely with the aperture diameter $d_o$. This important characteristic suggests the use of small apertures in order to reduce the distance Z required to produce the air-gas ratio required. Since the jet is turbulent, the motion is unsteady so that the instantaneous velocity must be replaced by a velocity which represents the average velocity over a finite time interval of sufficient magnitude. Although the velocity field has radial as well as axial velocity components, only the axial components $v_Z$ have significance in the analysis. Thus, $v_Z$ represents the time averaged axial velocity component. The velocity is a maximum along the Z axis which is the centerline of the jet, and this velocity which decreases with distance along the Z axis, is designed $(v_Z)$ max. Equation III of FIG. 4 will give the value of the centerline velocity $(v_Z)$ max. if both sides of the equation are multiplied by $V_o$. Thus, the produce $V_o d_o$ will appear on the righthand side. Equation I also contains the product $V_o d_o$. This product $V_o d_o$ is often designated as the strength of the free turbulent jet. FIG. 8 shows a plot of the centerline velocity $(v_Z)$ max. The curve $v_{Z1}$ in FIG. 4 has a profile which is similar to the inner cores of the gas flames emanating from the port orifice of a conventional gas burner. Curve $v_{Z2}$ shows that the width of a free turbulent jet increases with the distance of travel from the aperture $d_o$. The curves $v_{Z1}$ and $v_{Z2}$ which give the radial distribution of the paraxial velocities $v_Z$ are obtained by plotting equation IV for all values of the radius.

Figure 5:
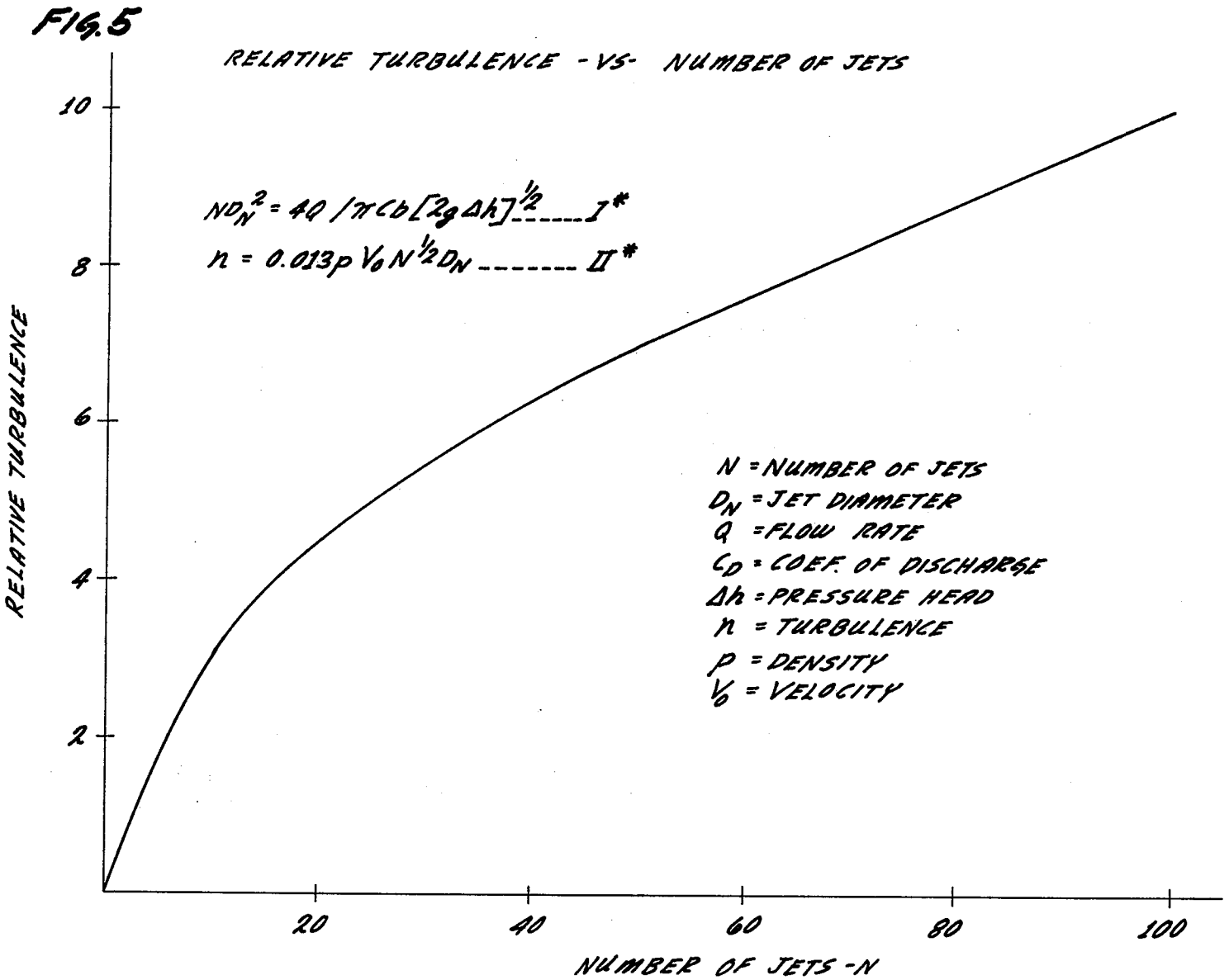
FIG. 5 gives the relative increase in the total quantity of turbulence obtained when a single free turbulent jet is replaced by two or more free turbulent jets under the conditions that the total volume of flow and the static pressure are identical in every case.

The ability of the jet of gas to entrain and mix the contiguous air with the gas depends on the product of the efflux velocity and the orifice diameter. This product is directly proportional to the amount of turbulence in the jet. Equation I of FIG. 4 shows that the turbulence which has the dimensions of viscosity, depends on the density of the primary fluid in addition to the strength of the jet as given by the product of efflux velocity and orifice diameter. The velocity of gas efflux from the orifice depends on the static pressure and the flow rate depends on the jet orifice diameter. Likewise, the product of the static pressure and flow rate of the gas is equal to the power in the jet. In other words, the turbulence depends on the fluid power available. The turbulence depends on the interaction of a primary fluid leaving the orifice with a secondary fluid which is contiguous and this interaction is a surface phenomenon. This fact suggests that a number of smaller jets with the same total area as the larger one would have more surface area and therefore more turbulence, because the ratio of the circumference of a circle to its area is inversely proportional to its diameter. FIG. 4 shows the flow field wherein a secondary fluid flows in a direction normal to the axis of the primary fluid. This means that there must be a substantial amount of space between two free turbulent jets. The entrained secondary fluid is in turbulent motion with the primary fluid, with the result that a homogeneous mixture of the two fluids exists in each plane normal to the jet axis. It is obvious from the figure that the width of the jet increases linearly with distance along the axis, but that it does not have a well defined line of demarcation, but, rather, a statistical diameter. Because of the importance of knowing the magnitude of the increase of turbulence with the number of jets, I derived an equation, the graph of which is presented for the first time in FIG. 5. This equation shows that the turbulence increases with the square root of the number of jets, which means that sixteen jets have four times the amount of turbulence as a single jet with the same total capacity. Equation I, of FIG. 5 is an analytic expression which defines the conditions for an invariant capacity. The static pressure at each orifice or aperture must be identically equal to each other and the same as the static pressure of the single large orifice which the N apertures replace. The sum of the flow rates of the N apertures must be equal to the flow rate of the single large orifice which they replace. The graph of equation II of FIG. 5 expresses the total turbulence in relative magnitudes as a function of the number of apertures. One can readily see why the prior art gas burners with a single spud aperture have such a small capacity when fully aerated, compared to the capacity of a burner which was able to use a large number of apertures. The use of multiple throats or a large number of small burners is successful if the primary aeration is low, but the fully aerated burners cannot be successfully cascaded. Curve A2 of FIG. 1 shows that a burner with a throat diameter of 1.25 inches has a gas flow rate of 13.75 CFH and if this burner was replaced with burners having a 0.5 inch throat diameter, it would take a total of 3½ burners to obtain the same flow rate. However, a single burner with a 1.0 inch throat has a gas flow rate of 10 CFH. Thus, the additional 2½ burners only increased the flow rate by 3.75 CFH, which is an average of only 1.5 CFH per burner for the additional 2½ burners. The employment of a multiplicity of apertures provides a phenomenon which is fundamental to my new principle burner. The smallest number of apertures which I prefer to use is twelve.

Figure 6:
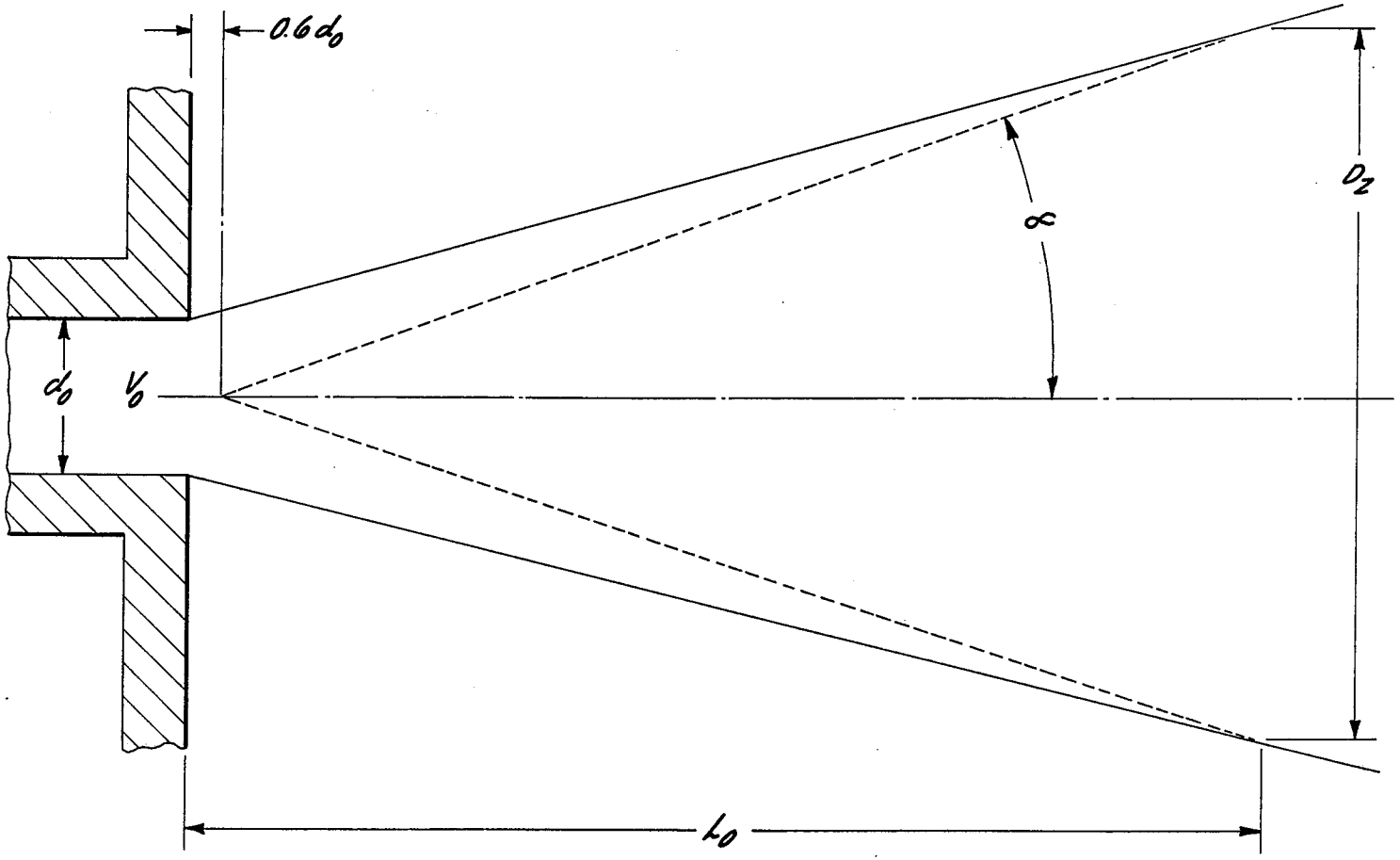
FIG. 6 graphically describes some of the geometric properties of a free turbulent jet.

FIG. 6 is a graphical representation of some of the salient characteristics of a free turbulent jet. The fluid leaves the orifice with diameter $d_o$ with a velocity $V_o$ which is determined by the fluid pressure and the coefficient of discharge of the orifice which may range between 0.61 for a square edge orifice to values in the range of 0.88 to 0.98 for well designed nozzles. The jet does not entrain any of the contiguous fluid until it reaches a distance which is 0.6 of the diameter of the orifice which becomes the origin for the equations. Since the jet diameter increases linearly with Z and the centerline velocity decreases inversely with Z, the Reynolds number is a constant throughout the flow region. Turbulence starts at the origin of Z and increases linearly with distance until a distance $L_o$ is reached where the turbulence is fully developed, which is equal to seven times the orifice diameter.

A free turbulent jet of fuel gas emanating from an aperture located in a horizontal plane wall of a chamber connected to a fuel-gas source, will entrain the contiguous air. The flow rate of the entrained air is a linear function of both the height of the jet above the Z origin (as shown in FIG. 6) and the fuel-gas flow rate, and is also an inverse function of the aperture diameter. The equation (FIG. 4–II) contains the empirical Gaussian constant which I have found to be accurate at the actual stoichiometric jet diameters. Equation II, $Q = 0.28\ Q_oZ/d_o$ can be simplified by recognizing that $Q/Q_o$ gives the ratio of the flow rate of the air entrained by the jet to the flow rate of the fuel-gas which is the primary fluid of the jet. This is just the usual air-gas ratio in combustion theory and is usually designated R. The resulting equation $R = 0.28\ Z/d_o$ can be solved for the independent variable Z. The variable Z is thus given by $Z = 3.57\ R\ d_o$. H. Reichardt - page 501, Schlichting's — *Boundary Layer Theory,* determined experimentally that the half width at half depth is given by the expression 0.0848 Z. The jet half width $b\ \frac{1}{2}$ is therefore given by $b\ \frac{1}{2} = 4 \times 0.0848Z$, i.e., $b\ \frac{1}{2} = 0.339\ Z$. The jet diameter is thus $D_z = 0.678\ Z$. Substituting the value of Z given above results in the equation $D_s = 2.42\ R\ d_o$. Consequently, if a fuel-gas discharges from an aperture having a diameter $d_o$ and if the air-gas ratio or if the fuel-gas is known, the diameter of the jet at which all of the air required for complete combustion of the air-gas mixture, is given by the equation $D_s = 2.42\ R\ d_o$. The equation $Z = 3.57\ R\ d_o$ gives the height of the plane normal to the Z axis at which the air-gas ratio R will be obtained. The arctan of the jet half angle is given by the ratio $2.42\ R\ d_o/2)/3.57\ R\ d_o$ which equals 0.3417. The jet included angle is therefore 37.57°.

A single jet discharging vertically in the atmosphere from an aperture will continue to entrain air for a considerable distance depending on the gas pressure. In order to obtain a specific air-gas ratio, it is necessary to shut off the induction of air when the jet reaches the Z elevation corresponding to the air-gas ratio desired. The method which I use to accomplish this result is to use an array of apertures which are equally spaced from each other a distance apart $D_s$ which is given by the equation $D_s = 2.42\ R\ d_o$. In order to obtain a quantitative conception of the resulting phenomenology, it is necessary to examine FIGS. 7 and 8.

Figure 7:
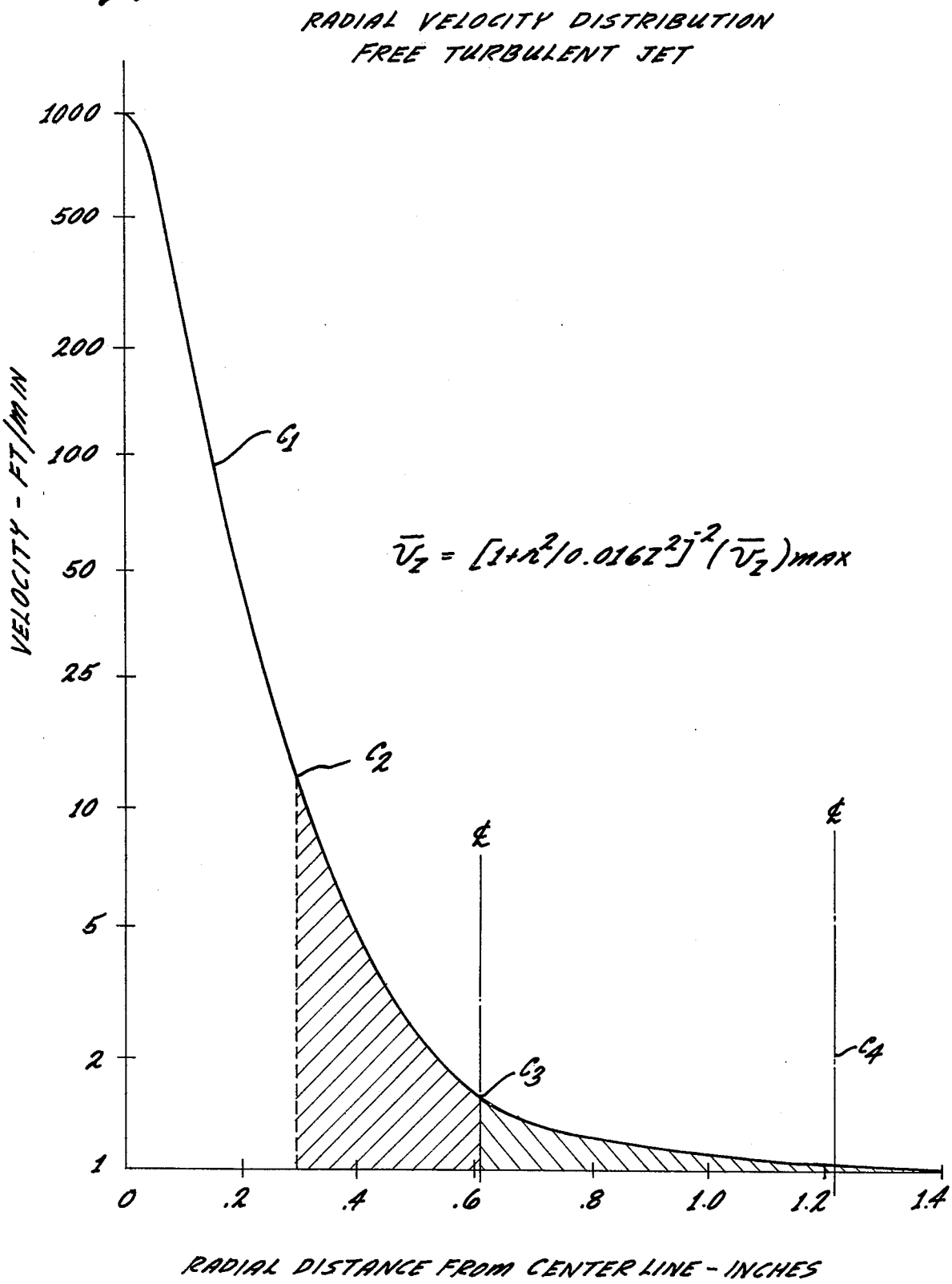
FIG. 7 is a graph of the radial velocity distribution in a plane normal to the axis of a free turbulent jet where the entrained air in the jet has a magnitude which is ten times the quantity of gas.

FIG. 7 is a graph of the radial velocity distribution in a plane normal to the Z axis for the jet described above. The logarithmic scale is used because of the great range of the velocities. The portion of the curve which extends from the centerline of the jet where r = o to the jet boundary where r = 0.302 inches is designated C1. The centerline of the adjoining jet is located at r = 0.605 inches. The velocity curve for the adjouning jet intersects the velocity curve for the first jet at point C2. The velocity curve of the first jet intersects the centerline of the second jet at point C3 and in addition does not reach a zero value until it reaches C1 the centerline of the third jet. The velocity distribution function does not portray a physical reality. The great value of this function is due to the fact that the flow distribution function can be derived from it.

FIG. 8 is a graph of the flow rate distribution function which provides a quantitative evaluation of the interaction between two contiguous free turbulent jets with aperture diameter of 0.025 inches and an air-gas ratio of 10 to 1. This distribution function is obtained by multiplying the area of an incremental annular ring by the mean value of the velocity of flow through the ring. The annular rings have equal radial increments $\Delta r$ but the area of the rings increases with distance from the center. Thus, the area of the annular ring between r 5 and r 4 would equal $\pi\ (r\ 5^2 - r\ 4^2)$ where $r\ 5 - r\ 4$ is equal to $\Delta r$ which is an assumed constant. The mean velocity of flow through any specific ring is equal to one-half the sum of the velocities of two successive radii.

Thus, $\overline{V}_5.5_1\ 4$ equals one-half V 5 plus V 4 and $\overline{r}$ 5, 4 equals one-half r 5 plus r 4. The flow rate through this specific ring is equal to the product of $\pi\ (r\ 5^2 - r\ 4^2)$ by $\overline{V}$ 5, 4. The largest areas are multiplied by the smallest velocities and vice versa. Whereas, the velocities ranged from zero to about 1000 ft/min., the flow rates only range from zero to about 100 $ft^3$/min.

The flow rate distribution function has one unexpected characteristic, namely, that the flow rate is not a maximum at the center of the free turbulent jet. Since the scale of the graph is linear, it is very important to study the composite result when two stoichiometrically spaced free turbulent jets interact. However, since the free turbulent jets are circular, the magnitudes of the interaction shown on the graph would apply only at the line drawn between the center of the two jets. The curve D1 shows that the flow rate of a free turbulent jet is about 10% of its maximum value at the theoretical stoichiometric radius and is essentially zero at a distance equal to the same stoichiometric diameter. The effect of the addition of the free turbulent jet D is to double the flow rate at the theoretical stoichiometric radii at the line of tangentcy D3. Thus, the flow rate at this line is a little over 20% of the maximum flow rate of the respective jets. This overlapping of the flow rate distribution functions of two free turbulent jets will be defined to be a coalescing junction. This unique phenomenon of stoichiometric coalescence is the basic element in determining the magnitude of the empirical stoichiometric spacing of the apertures.

In particular, an array of apertures with diameters $d_o$ with a linear distance Ds between the apertures equal to $2.42 \cdot R \cdot d_o$ produces a plurality of free turbulent jets entraining an amount of air given by that ratio R. If additionally R is chosen to be the stoichiometric ratio, then the jets coalesce when the entrained amount of air equals exactly the amount needed for complete combustion. A slightly smaller spacing, corresponding to the relation $2.4 \cdot R \cdot d_o$ produces an air-gas-ratio, still tolerably below the needed stoichiometric ratio. A spacing being up to about 15% larger than $Ds = 2.42 \cdot R \cdot d_o$ produces an air-gas mixture that is somewhat diluted but still sustains combustion, but at a smaller density in heat development. I found experimentally that a spacing being more than 15% larger than $Ds = 2.42 \cdot R \cdot d_o$, produces jets which even after coalescence, could not sustain combustion on account of excessive dilution of the fuel with air.

Therefore, the aperture spacing should be ideally equal to $Ds = 2.42 \cdot R \cdot d_o$ which is the stoichiometric spacing for an R equal to the stoichiometric air-gas ratio. Any deviation of the spacing from the stoichiometric spacing should not be larger by more than 15% and not smaller by about 1% of the stoichiometric spacing for Ds. In other words, for a given stoichiometric ratio R, the linear spacing of apertures in an array should not be smaller than $2.4 \cdot R \cdot d_o$ and not larger by about 15% or even more than the ideal value $2.42 \cdot R \cdot d_o$. This means that the spacing Ds should not be smaller than about 2.4 do for the usual value of R = 10 for natural gas, and Ds should not be larger than about 29 $d_o$.

The coalescence produced by an array of stoichiometrically spaced free turbulent jets of a stoichiometric air-gas mixture is also of great importance because the coalescence plane forms a demarcation barrier which separates the flame from the unburned air-gas mixture and because there is a pressure drop across this demarcation barrier. The static pressure of the unburned mixture is less than the atmospheric pressure. This unique phenomenon is of fundamental importance because it provides the modus operandi which prevents lift-off of the flame.

My burner has three zones, namely, a chamber which is connected to a source of gaseous fuel which leaves the chamber through apertures positioned in the top planar surface, a mixing zone containing the free turbulent jets emanating from the apertures positioned in the top planar surface, a mixing zone containing the free turbulent jets emanating from the apertures which terminate in the stoichiometric coalescing demarcation barrier, and a combustion zone which extends from the demarcation barrier to the surface of the object to be heated.

The burners consist of a chamber having an inlet connected to a source of fuel-gas and a planar top surface containing various aperture arrays which will produce an inner region having a static pressure less than the atmospheric pressure. The chamber zone must be so designed that the velocity head of the inlet fuel gas is transformed into a uniform static pressure at the aperture inlets in order to obtain equal flow rates of the fuel gas from each aperture.

The apertures which are positioned in the planar top surface of the chamber are arranged in two groups. The apertures in each group are spaced in the stoichiometric distance apart according to the relation $D_s = 2.42 \times R\ d_o$ and the apertures in the inner group are likewise spaced stoichiometrically with respect to the apertures in the outer group. The outer group entrains part of its combustion air from the region external to the array. All of the air required by the inner group of the free turbulent jets passes between the outer group of free turbulent jets. Likewise, the outer group of free turbulent jets obtains the remainder of its combustion air from the inner region. The static pressure of the air contiguous to the outer free turbulent jets is obviously equal to the barometric pressure. All of the air entering the inner region passes through a surface which is bounded by the stoichiometric plane above and the top of the burner below. The magnitude of this area is obtained by multiplying this stoichiometric spacing by the length of the line passing through the centers of the outer group of apertures. The velocity of the air entering the inner region is equal to the ratio of the quantity of air entering the inner free turbulent jets plus the quantity of air entering the inside surfaces of the outer free turbulent jets, divided by the area as mentioned above. This velocity is given by the equation $V_a = 0.027\ N_i Q_o / N_o d_o^2$ where $N_i$ and $N_o$ are the equivalent numbers of inner and outer apertures. $Q_o$ is the aperture gas flow rate and $d_o$ is the aperture diameter. This flow of gas must satisfy Bernouli's equation which in this case reduces to th form wherein the sum of the velocity head and the static head must be a constant along any streamline. Thus, the sum of the velocity and static heads within the inner region must be equal to the barometric pressure external to the outer row of apertures. Therefore, the static pressure within the inner region is less than the barometric pressure by the velocity pressure within the inner region. The magnitude of the negative static pressure of constraint is given by the equation $\Delta h = V_a^2/16$. This negative pressure constraint prevents lift-off of the flame.

I have developed five basic burner forms which are the building blocks for more complex burner types. The following table presents the negative pressure constraints which prevent lift-off.

| Array | Apertures | Velocity Ft/Min. | Static Pressure Micro-inches W.C. |
|---|---|---|---|
| Hexaform | 18 | 62.5 | 245 |
| Paraform A | 28 | 57.7 | 208 |
| Deltaform | 12 | 49.2 | 152 |
| Octoform | 25 | 41 | 105 |
| Quadriform | 12 | 33 | 68 |
| Septor | 7 | 31.2 | 61.5 |
| Paraform B | 19 | 30.6 | 58.6 |

The septor burner is described in my copending application.

The mixing zone bounded by the burner top surface and the demarcation barrier produced by the turbulent jet coalescence has a height given by the expression $h_m = (3.57\ R + 0.6)\ d_o$. The mixing zone transforms the velocity head of the combustion air into the reduced pressure of the inner region of turbulent jets which constitute the negative pressure constraint which prevents lift-off of the flame at the coalescing stoichiometric plane.

The combustion zone which extends from the coalescing stoichiometric plane, i.e., demarcation barrier, to the surface of the object to be heated has a definite minimum height which depends on both the air-gas ratio of the gaseous fuel and the specific burner form. This minimum spacing is established when the propagation of the flame front has a velocity such that combustion is complete at the instant that the moving volume of reactants are completely transformed into the combustion products. If the height of the combustion zone is less than this minimum value, yellow flames appear in the central region of the flame. I determined experimentally the height of the combustion zone for a hexaform burner having an aperture diameter of 0.025" and burning a natural gas which required 10 volumes of air for 1 volume of fuel gas. I found that the minimum height of the combustion zone was practically twice the height of the mixing zone $h_m$. Thus, for a hexaform burner, the height $h_c$ of the combustion zone is given by the expression $h_c = 2.0\ (3.57\ R + 0.6)\ d_o$.

The stoichiometric spacing is the most fundamental parameter of my burner. This unique parameter depends solely on the aperture diameter $d_o$ and the air-gas ratio R. The aperture diameter $d_o$ is obviously a free variable. If the second parameter R is to be the stoichiometric air-gas ratio, then only a single value of this parameter is valid for any specific gaseous fuel. However, small increases in the magnitude of the air-gas ratio have relatively little effect on the properties of the flame. The salient properties of the flame are its temperature and its reaction velocity. When the aeration exceeds the stoichiometric ratio, oxygen appears in the flame. The stability of the flame with respect to lift-off due to drafts is not noticeably affected. The subject of air-gas ratios introduces the term stoichiometry, which in turn is the stoichiometric mixture which is defined as the mixture of fuel and oxidizer which has the correct initial composition to theoretically produce a product mixture which contains only the species $N_2$, $CO_2$ and $H_2O$. The Los Angeles gaseous fuel has a stoichiometric mixture air-gas ratio of 10.3 to 1 and a heating value of 1,050 BTU per $ft^3$. Thus, the stoichiometric apertue spacing is given by the expression $D_s = 25\ d_o$ in this area.

My early experiments indicated that there was a relation between the average number of coalescing junctions per aperture and the flame stability as indicated by lift-off induced by cross-winds. I postulated that lift-off will not occur if the number of coalescing junctions per aperture average 2.67 or more. This conclusion was self-evident since my quadriform array had 2.67 coalescing junctions per aperture and the fact that they were quite stable. I also reported that a closed ring of apertures which has 2.0 coalescing junctions per aperture would lift-off and that a line-segment of 10 apertures which had an average of 1.8 coalescing junctions per aperture, lifted-off at a higher rate than the closed ring of apertures. In a similar situation it is found that a line-segment of 19 apertures has a coalescence of 1.9.

My experiments with the single loop burners were in error because of two reasons. The outer loop of the quadriform burner and the inner loop of the octoform burner were not spaced the stoichiometric distance apart. The inner loop of the quadriform with only 4 apertures had too small of a negative pressure constraint. However, a long time later I realized that the paraform B burner was a single loop burner and the negative pressure was very satisfactory. I then repeated a single loop experiment using six peratures in a hexagonal array with my latest stoichiometric spacing, which has more stability than my previous empirical spacing.

The performance of this six aperture single loop burner, which I designate as a Hextor burner, is very satisfactory. The negative pressure contraint is 46% of that of a paraform B burner which has 19 apertures. All single closed loops, regardless of configuration, have 2.0 coalescing junctions per aperture.

The correlation between the number of coalescing junctions and the stability which is accurately measured by the negative pressure of constraint, leaves something to be desired. My conclusion is that both of them are important yardsticks of the behavior to be expected, but that the nature of the array and the number of apertures are additional factors that influence coalescence and constraint differently. The following table presents the facts for what they are worth.

| Array | Apertures | Junctions/ Aperture | Static Pressure Micro-inches W.C. |
|---|---|---|---|
| Hexaform | 18 | 4.00 | 245 |
| Paraform A | 19 | 3.70 | 176 |
| Deltaform | 12 | 4.00 | 152 |
| Octoform | 25 | 2.24 | 105 |
| Quadriform | 12 | 2.67 | 68 |
| Septor | 7 | 3.43 | 61.5 |
| Paraform B | 19 | 3.80 | 58.6 |

The foregoing theories and experiments have created the following derivative principles which are the essence of my stoichiometric burner.

AXIOM I. In order to constrain the base of the stoichiometric plane, there must be an interior region below the stoichiometric plane which has a negative pressure in reference to the atmospheric pressure.

AXIOM II. The stoichiometric spacing between apertures and for similar fuel gas and air temperatures depends solely on two parameters, namely, the air-gas ratio and the aperture diameter. The following equation for the stoichiometric spacing has been derived by theoretical considerations and has been verified by empirical methods:

$$D_s = 2.42\ R\ d_o$$

AXIOM III. The stoichiometric plane which is the demarcation barrier which separates the unburned gas in the mixing zone from the flame base is always positioned above the top surface of the burner at a distance which is always greater than 3.57 R $d_o$, i.e., $h_m = 3.57\ R\ d_o$ where $h_m$ is the height of the mixing zone, and R is the actual air-gas ratio obtained for an aperture spacing $D_s$ equal to $2.42 \cdot R \cdot d_o$.

AXIOM IV. There is a minimum space between the top of the burner and a surface to be heated which will provide complete combustion. After ignition, the flame front propagates vertically at a velocity which is greater than the flow of the gas products which are behind the flame front. This difference in velocity reduces the transit time available for the reaction to reach completion. The minimum space between the burner top surface and the surface to be heated, for complete combustion, depends on the burner aperture array, the fuel gas pressure, the air-gas ratio, the stoichiometry, and the aperture diameter. However, domestic appliances usually have a regulated gas pressure of 3.5" w.c. Therefore, the height of the combustion zone above the stoichiometric plane is given by the following equation: $h_c = K_b\ R\ d_o$, where $K_b$ is an empirical constant for a specific burner. The height of the combustion zone can also be expressed in units of mixing zone heights, i.e., $h_c > K_b\ [3.57\ R\ d_o]$.

AXIOM V. Flame stability increases with the amount of turbulence per unit flow rate of the gaseous fuel emanating from an aperture. For a given flow rate of a gaseous fuel from the burner apertures, the total turbulence of the free turbulent aperture jets will increase with the square root of the number of apertures. The turbulence produced by a single free turbulent jet is directly proportional to the product of the aperture diameter and the gas efflux velocity.

AXIOM VI. Flame stability increases with the aperture diameter. The magnitude of the negative pressure constraint is proportional to the square of velocity of the air flowing through the peripheral area between the stoichiometric plane and the burner top surface. This air velocity is equal to the ratio of the air flow rate to the peripheral surface area described above. The air flow rate is proportional to cube of the aperture diameter, whereas the peripheral surface area is proportional to the square of the aperture diameter. Therefore, the air velocity is directly proportional to the aperture diameter.

AXIOM VII. Flame stability increases with the gas pressure. The gas flow rate is directly proportional to the square root of the gas pressure. The air flow rate is directly proportional to the gas flow rate, whereas the peripheral surface area depends solely on the aperture diameter. Therefore, the air velocity (which is the ratio of the gas flow rate to the peripheral surface area) will increase directly with the square root of the gas pressure. Since the negative pressure constraint is proportional to the square of the air velocity, it will be directly proportional to the gas pressure. In addition, the gas efflux velocity at the aperture will increase directly with the gas flow rate so there is also an increase in the turbulence which is directly proportional to the efflux velocity.

AXIOM VIII. A stoichiometric mixture of air and gaseous fuel will be invariant before ignition of the temperatures if the air and fuel are identical and have the same temperature of the environmental ambient temperature.

AXIOM IX. A natural gas (L.A.) and air flame will lift-off if the stoichiometry is 1.20 or more.

AXIOM X. A natural gas (L.A.) and air flame will lift-off if the natural gas has a pre-ignition temperature of 177° F. or higher with the air at a temperature of 70° F.

After the formulation of my so-called axiomatic principles, it occurred to me that there should be other embodiments of these principles in addition to the dual loop burners. I was amazed how easy it was to deduce three new basic arrays which in turn had two modifications. These arrays are designated Paraform and Toroform, and the modifications are differentiated by the subscripts A and B.

BURNER DESIGN CONSIDERATIONS

My burner is unique in that all of the air for stoichiometric combustion is mixed with the gaseous fuel external to the burner. The gaseous fuel in the burner chamber has the same temperature as the ambient environment and therefore in the case of Los Angeles natural gas, has a density of 0.046 lbs/ft$^3$. Domestic appliances such as ranges have a pressure regulator which is set at 3.5" w.c. This pressure is transformed into velocity by the aperture in the top surface of the burner chamber. There is a pressure loss, however, in the aperture. There are two types of apertures in general use, namely, the channel type and the sharp edge ofifice. The efficiency of the channel type aperture reaches a maximum value when the length of the channel is twice the aperture diameter. The sharp edge orifice has a maximum value as the orifice thickness approaches a very small value. The channel type apertures have efficiencies of 82% and the sharp edge orifices have efficiencies which are only slightly higher. Assuming an orifice efficiency of 80%, the velocity of discharge of the gaseous fuel from the orifice is 8350 ft/min. This free turbulent jet will entrain the 10.3 volumes of 70° F. air required for the stoichiometric mixture with Los Angeles natural gas. Applying the law of conservation of momentum, the stoichiometric mixture of air and gaseous fuel will have a velocity of 312 ft/min at 70° F. The velocity head of the jet is therefore approximately 0.003" w.c. After ignition, the temperature of the gas products rises rapidly to a temperature of 2200° F. The density of the gas products before ignition was about 0.072 lbs/ft$^3$ at 70° F. and at the flame temperature becomes about 0.014 lbs/ft$^3$. Since the flame is surrounded by air at atmospheric pressure, there will be a pressure produced by the flame due to the difference in density of the air and gas products. The pressure produced will also be directly related to the height of the gas products. The pressure produced is directly proportional to the product of the density difference and the height of the column of gas products. Assuming a column height of 6 inches, the pressure produced would be approximately 0.003" w.c. The total head is therefore 0.006" w.c. The prior art burners dissipate the original head at the orifice, in the diffuser or mixing tube, and the ports which prevent lift-off of the flame. My burner uniquely combines a high flame temperature in combination with a pressure to force the gas products through passages, etc.

When my burner is used to heat metals or ceramics to high temperatures, serious problems arise. It is helpful to examine the Stephan-Boltzman equation:

$$q_{net} = 0.0174 \times 10^{-8}\, e_h\, a_c\, F_h\, A_h\, (T_h^4 - T_c^4)$$

where $e_h$ = the emissivity of the hot body
$a_c$ = the absorptivity of the cold body
$F_h$ = the angle factor of the hot to cold bodies
$T_h$ = the Rankine temperature of the hot body
$T_c$ = the Rankine temperature of the cold body The important parameters are the emissivity of the hot body surface, the absorptivity of the cold body surface and the temperature of the hot body which is raised to the fourth power. Thermodynamics requires that the emissivity and absorptivity of a given body surface must be equal at any given temperature. The magnitude of the emissivity is also temperature dependent. For example, the emissivity of aluminum in the temperature range of 440° F. to 1070° F. varies from 0.039 to 057. Many refractories have emissivities of 0.8 to 0.9 in the temperature range of 1110° F. to 1830° F. The radiation from the surface to be heated emits radiation in accordance with Lambert's law of diffuse radiation. The radiation decreases in accordance with the cosine of the angle between a normal to the hot surface and the direction of the radiation flux. In the case of a gas broiler, I solved the problem by using a V-shaped, stainless steel radiator which emitted radiation in a 45° angle in each direction. Only a very small quantity of radiation was absorbed by the burner surface which was aluminum.

My most difficult problem was heating a ceramic top range with my burner. The emissivity of the ceramic is about 0.85 and it must be heated to a temperature of 1300° F. The combustion products must flow in opposite directions from the center of the ceramic top unit. If the burner products impinge normally to this surface, this velocity head is lost. I solved this problem by developing a new burner which I designate repulsoparaform-B. In addition, I introduce an aluminum silicate insulation and radiation reflectors between the burner surface and the ceramic top.

The final consideration is flame radiation. Flames are divided into two categories, namely, luminous and nonluminous. A flame is made luminous by the presence of glowing particles of carbon. Such flames tend to follow the normal Stephan-Boltzman rate equation which is a continuous spectrum. Non-luminous flames emit energy at certain discrete wave lengths and these various regions of wave lengths are called spectral bands. However, radiation has to be considered with quite a few gases and in particular with those gases which partake in combustion processes such as carbon dioxide, water vapor, carbon monoxide, methane, and sulphur dioxide. The blue flame produced by my burner and primary air burners is a non-luminous flame. Townsend states in his book titled *FLAME AND COMBUSTION IN GASES,* that a Bunsen blue flame emits about 15% of its thermal engergy in the form of radiation. Thus, the radiation from the flame of my burner is in contradistinction to the quantity of continuous radiation from the flameless surface of a surface combustion burner wherein a premixed stoichiometric air-gas mixture burns catalytically within the interstices of loose refractory pieces having high emissivity and whereby the refractory material is heated to high temperatures.

THE STABILITY FUNCTION

I previously presented a quantitative evaluation of the two basic derived attributes which are the fundamental elements of the flame stability of different burner types. These derived attributes are dimensionally unrelated. The coalescence of the free turbulent jets is a mean dimensionless ratio. The negative pressure constraint which is produced by the flow of combustion air into the free turbulent jets has the dimensions of pressure or the height of a column of water. Therefore, there is no basis for any interdependence between these two parametric functions. The stability function which depends on both coalescence and constraint has the dimension of velocity since the stability is determined empirically by measuring the cross-wind velocity which will cause the flame to lift-off. However, both coalescence and constraint are independently determined by the number and geometry of the aperture array. Thus, symbolically, the stability function could be represented by the following equation:

$$S(V) = F\,C(G), P(G)$$

where

S (V) = the stability function

C (G) = the coalescence function

P (G) = the constraint function and

G = the number and geometry of the aperture array

It is desirable to determine experimentally the relative contribution of coalescence and constraint in regard to flame stability.

The previous material has provided the theoretical bases, the phenomenology and the practical considerations. The figures on the remaining drawings provide the detailed features of the various types of burners and their application in some cases.

Figure 9:
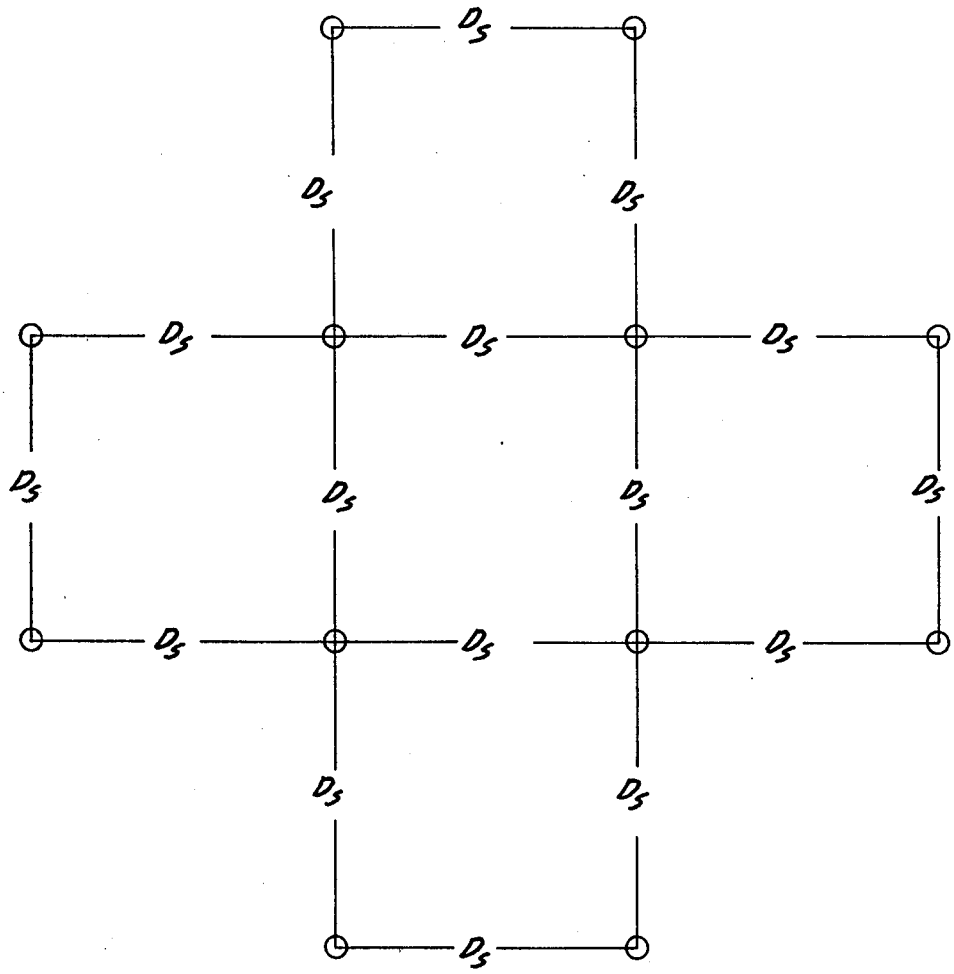
FIG. 9 shows a top view of a quadriform array.

FIG. 9 was my "Eureka" array of apertures as used in the model which was my first reduction to practice of a purely theoretical concept. All of the apertures were spaced stoichiometrically a distance apart of 0.625". The aperture diameters were 0.025". I assumed a 10 to 1 air-gas ratio and my equation for the aperture spacing was therefore $D_s = 25\ d_o$. The burner had an output of 24,800 BTU/hr. with a gas pressure of 4" w.c. The burner had a basic weakness since the spacing between the four pairs of corner apertures is 45% more than the stoichiometric spacing. The flame rises substantially in these regions, thereby entraining more air. The burner has no commercial value since its performance does not compare with other types with the same number of apertures. This quadriform array burner was the nucleus for the octoform array.

Figure 10:
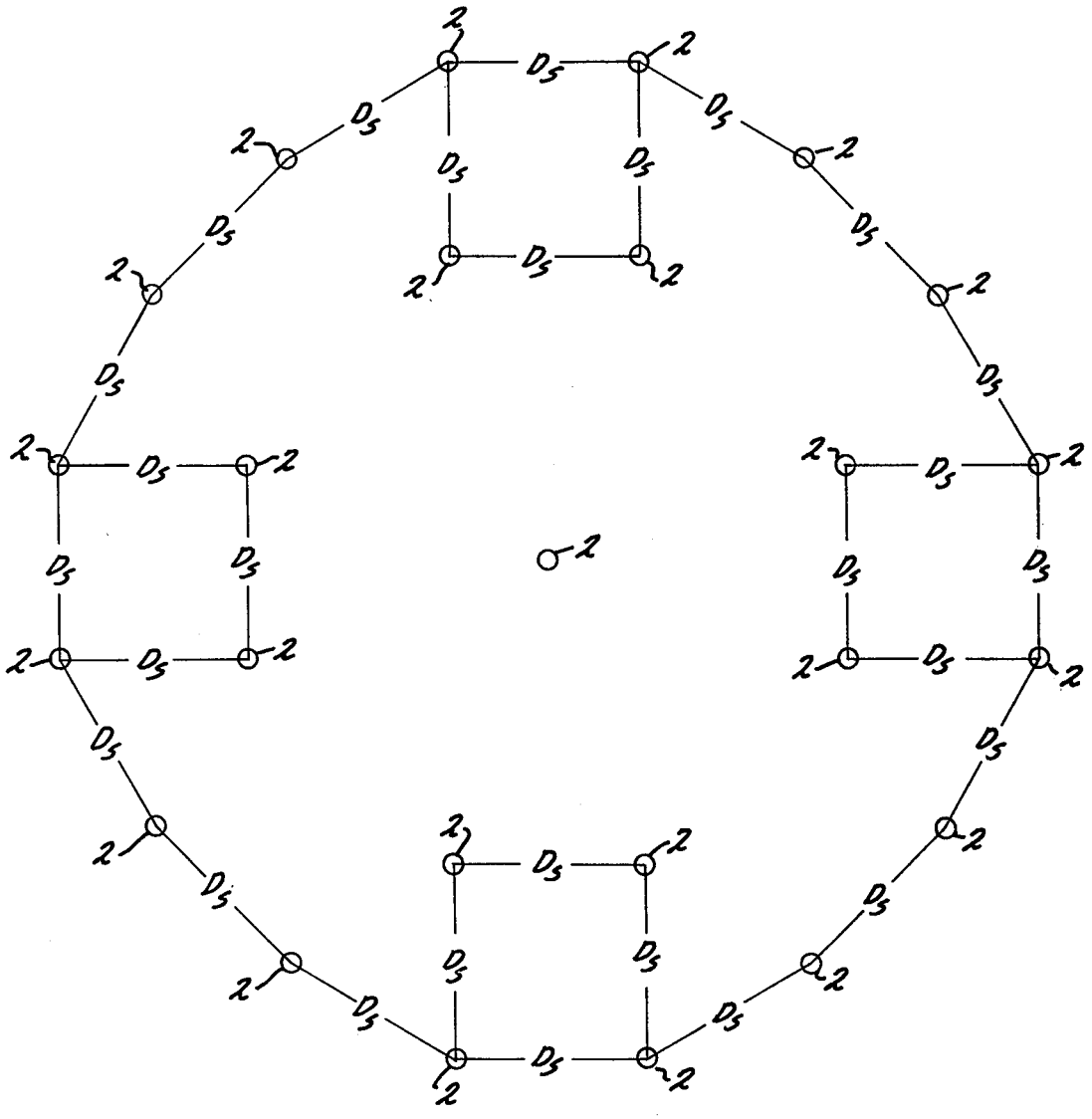
FIG. 10 shows the top view of an octoform array.

FIG. 10 shows the octoform array which has a stoichiometric outer array of 16 apertures. The inner eight apertures are the eight outer apertures of the quadriform array and therefore have the same 45% increased spacing compared to the stoichiometric spacing. This burner array also has no commercial value.

Figure 11:
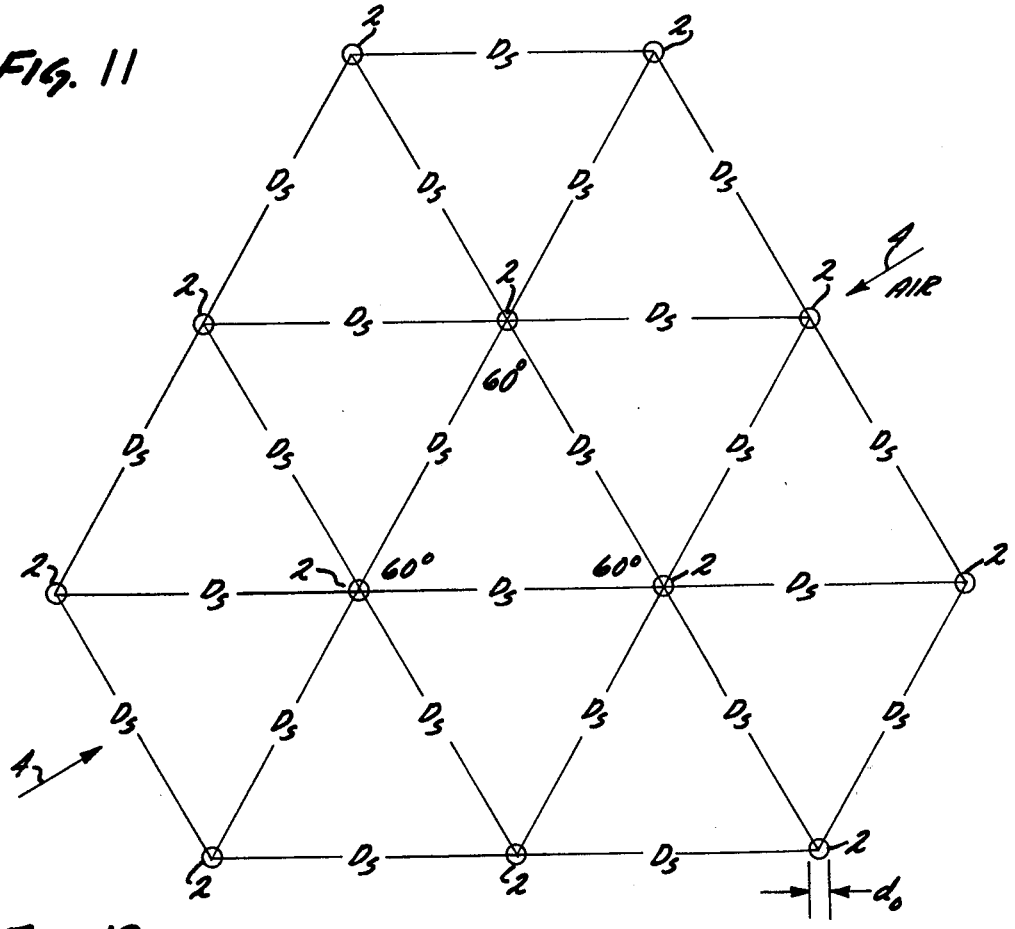
FIG. 11 shows a top view of a deltaform array.

FIG. 11 shows a top view of the deltaform burner array which was derived from the hexaform burner array which uses an isoscleles triangle as the building block. The performance of this burner is outstanding. The unique feature is the flame concentration and stability with only 12 apertures. This burner is especially useful for operation with flow directions having horizontal components.

Figure 12:
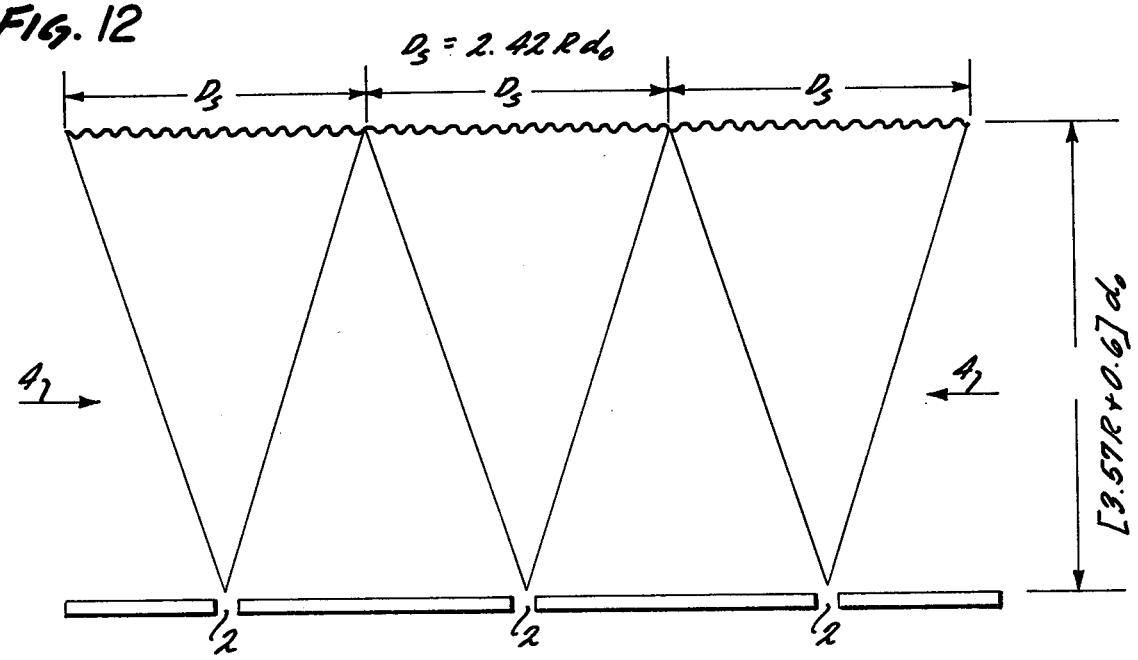
FIG. 12 shows an elevation of the free turbulent jets emanating from the apertures shown in FIG. 11.

FIG. 12 is an elevation of the burner array shown in FIG. 11. The free turbulent jets of fuel gas emanating from the apertures entrain the exact amount of air for combustion of the gaseous fuel. The stoichiometric diameter of the turbulent jets at the stoichiometric demarcation barrier is the same as the aperture spacing. My burner uniquely mixes all of the combustion air with the gaseous fuel in the space above and external to the burner chamber. The height of the stoichiometric plane above the burner top surface is never less than the height of the mixing zone which is given by the equation on the FIG. 14.

Figure 13:
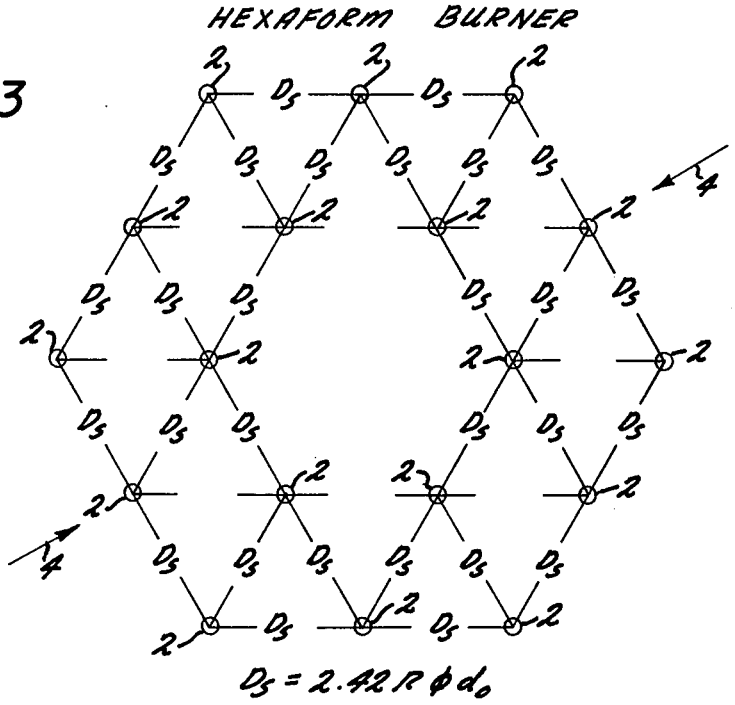
FIG. 13 shows a top view of the hexaform burner.

FIG. 13 shows a top elevation of the array of apertures of the hexaform burner. The performance of this burner is also outstanding. The flame temperature is somewhat lower than the deltaform burner due to the space within the inner loop of six apertures.

Figure 14:
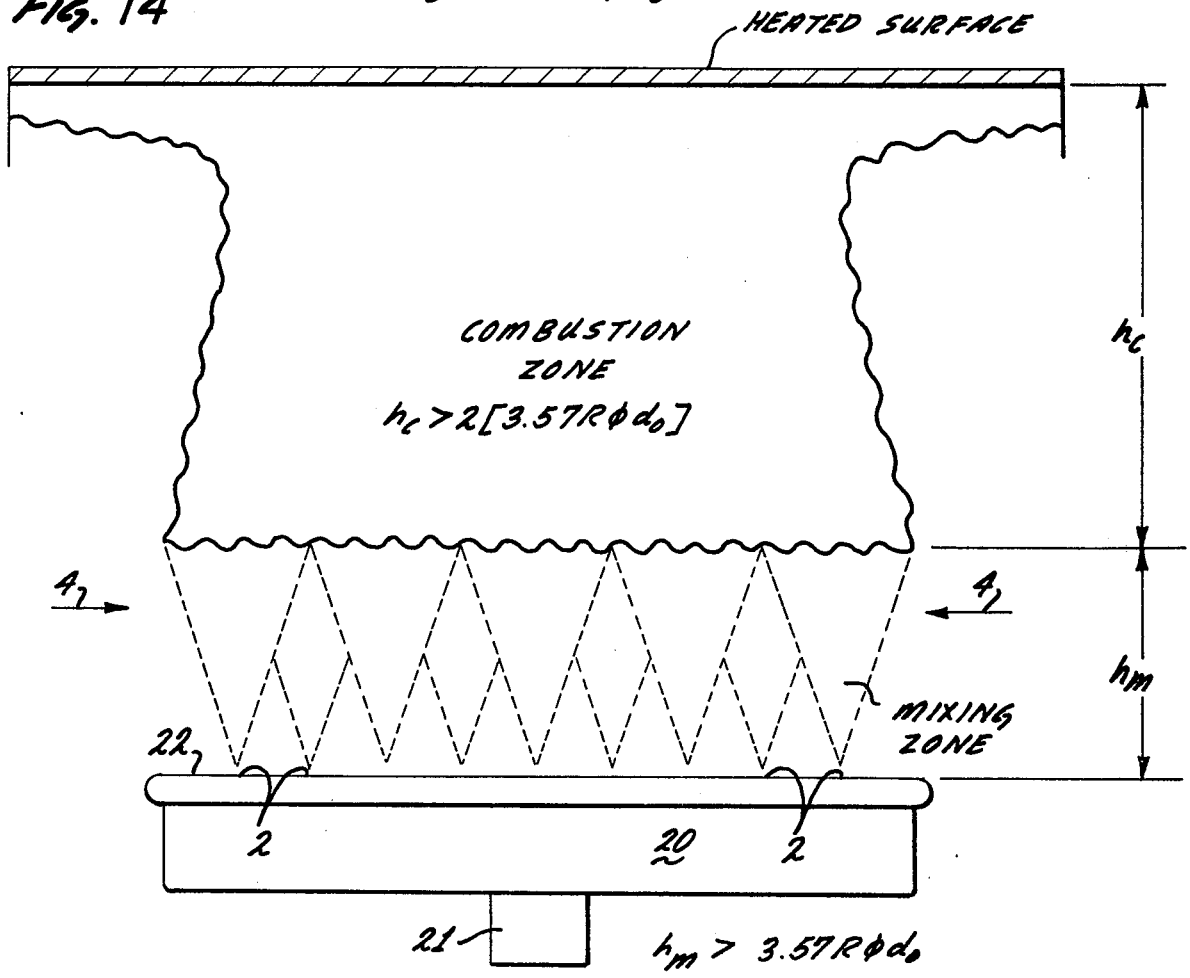
FIG. 14 shows an elevation of the burner shown in FIG. 13.

FIG. 14 is an elevation of the hexaform burner. The important feature of this drawing is the fact that there is a minimum space between the burner top surface and the surface to be heated. This space is more than three times the height of the mixing zone. The fuel gas emanating from the apertures 2 should have a temperature essentially the same as the combustion air entering the free turbulent jets. The top surface is polished aluminum. The radiation from the blue flame has a very small effect on the temperature of the burner top surface. The height of the combustion zone depends on the difference in flame front velocity and the gas products velocity. The height between the surface to be heated and the top 22 of the burner can, of course, be much larger than the combustion zone if desired. The bottom entrance 21 to the chamber 20 gives excellent static pressure uniformly.

Figure 15:
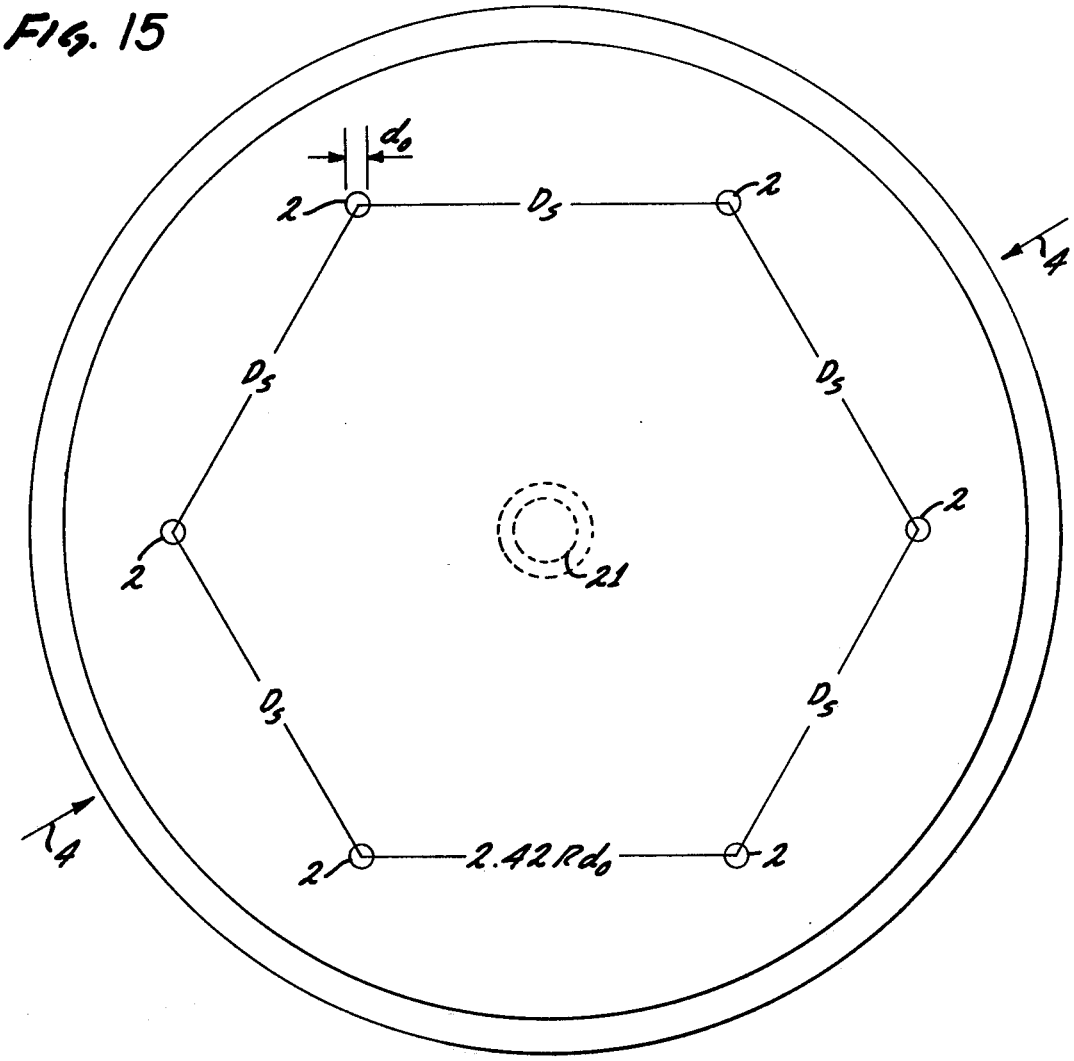
FIG. 15 shows a top view of the septor burner.
Figure 16:
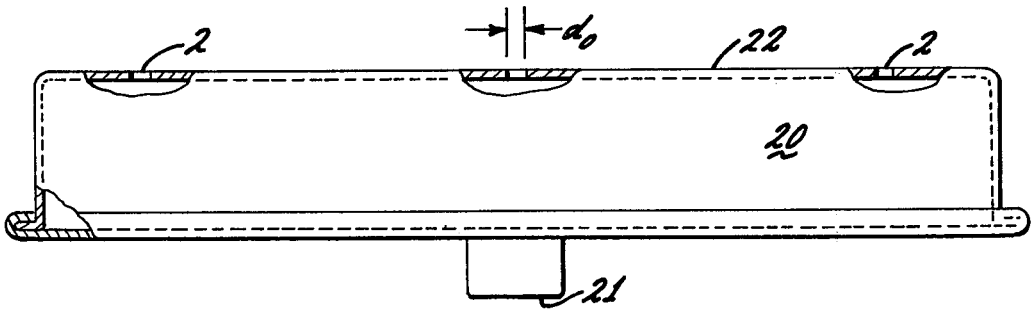
FIG. 16 shows an elevation of the septor burner.

FIGS. 15 and 16 show two views of a septor burner. The burner consists of a cylindrical chamber 20 with a flat top 22 which contains seven apertures 2 which are spaced toichiometrically a distance 3 apart. The combination air 4 enters radially. Gaseous fuel enters the chamber 20 through the inlet 21. This burner has outstanding characteristics for a burner with only seven apertures. The burner has combustion air velocity of 31.2 ft/min. which produces a negative pressure constraint of 61.5 micro-inches 2.c. The burner has 3.43 coalescing junctions per aperture and is extremely stable.

Figure 17:
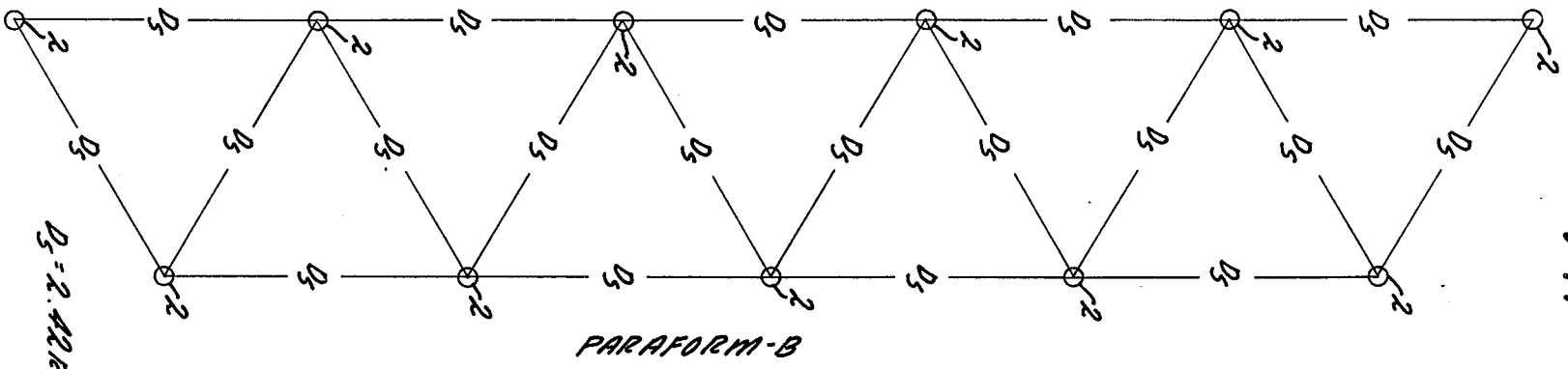
FIG. 17 shows a top view of the paraform-B array.

FIG. 17 shows a top elevation of a paraform-B array. This burner is most useful for heating rectangular surfaces. It is the ideal burner for furnace heat exchangers.

It increases the thermal efficiency and greatly reduces the size and cost of the heat exchangers and furnace casing.

Figure 18:
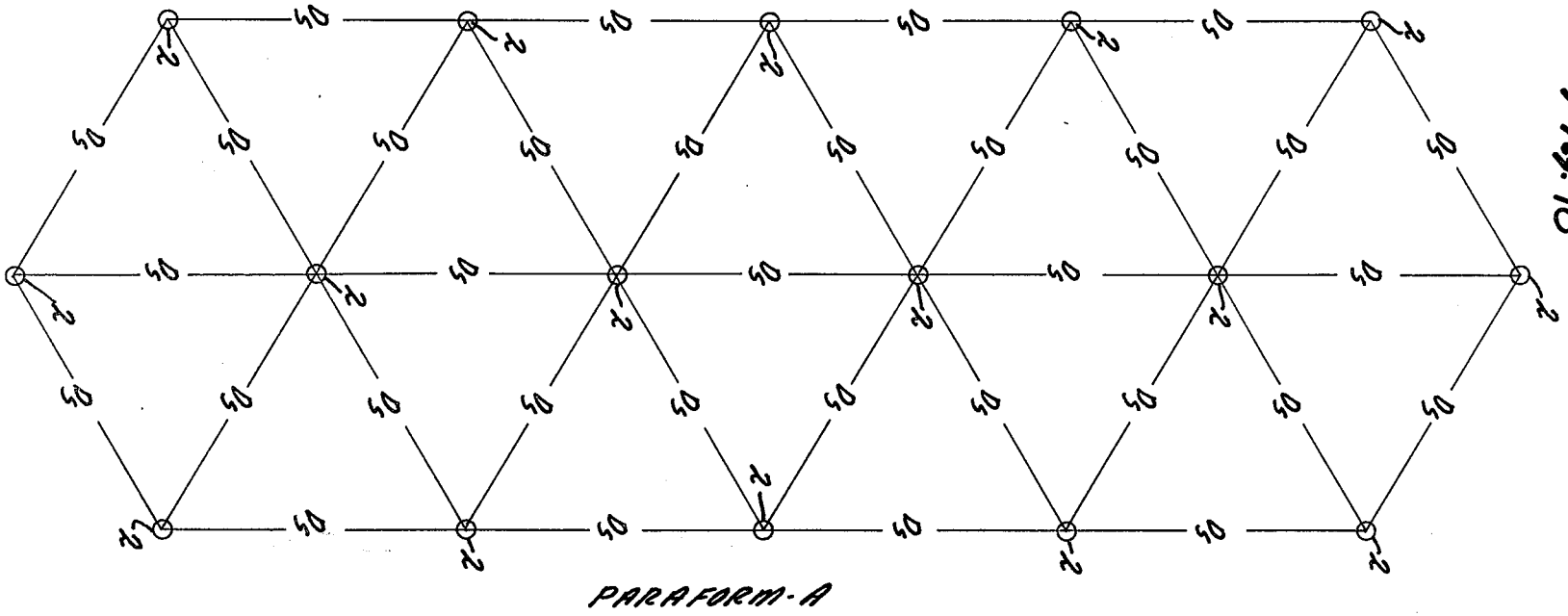
FIG. 18 shows a top view of the paraform-A array.

FIG. 18 shows a top view of the paraform-A burner array. This array can also be used in the hexatoroform burner array. The paraform-A burner has a great potential in the commercial and industrial fields where large heat outputs are required. This burner can have outputs of millions of BTU's/hr and it has a cost which is a fraction of the cost of the prior art burners with their complicated controls, blowers, etc.

Figure 19:
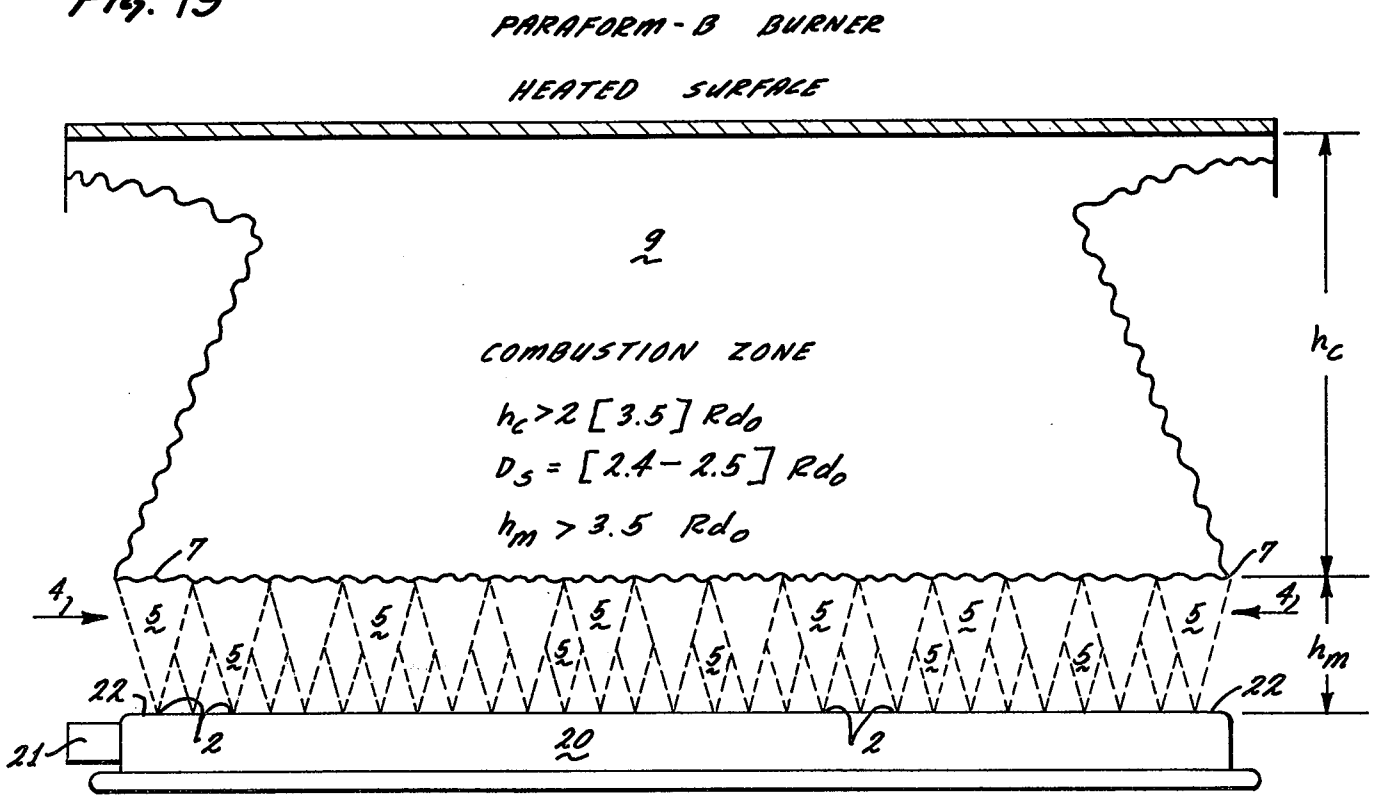
FIG. 19 shows an elevation of the paraform-B burner.

FIG. 19 is an elevation of the paraform-B burner which is the most versatile stoichiometric burner which I have developed. The gaseous fuel enters the inlet 21 and then flows into the chamber 20. The free turbulent jets 5 emanate from the apertures 2 which are positioned in the planar top surface 22 of chamber 20. The combustion air 4 enters the free turbulent jets 5 which coalesce in the stoichiometric plane 7 which is the top boundary of the mixing zone. The combustion is complete when the combustion products 9 reach the surface to be heated.

My burners uniquely provide stoichiometric combustion of gaseous fuel with sufficient static pressure for many heat exchangers. The most salient feature of stoichiometric combustion is the high temperature of the combustion products which range from 2200° F. to 2400° F., depending on the burner geometry. The heat flow to a given heat exchanger increases linearly with the correspondingly higher temperature gradient. The burning velocity is also almost twice as high as the prior art burner flame velocities. Thus, the height of the combustion space is reduced in the same ratio. As a result, the heat losses and cost of the much smaller combustion chamber are correspondingly reduced. In addition, the volume of the combustion products is much smaller than the corresponding volume of the prior art burners. This secondary excess air lowers the temperature of the combustion products and concomitantly increases the size of heat exchanger passages and surface areas. Finally, my burner has a fraction of the cost of the prior art burners.

While I have described a preferred embodiment of the invention in considerable detail for the purpose of illustration, if should be understood that the invention is not restricted to the specific details which I have shown. It will be apparent to those skilled in this art that many other embodiments, various changes and modifications may be made without exceeding the scope of the invention as defined by the following claims, wherefore, what I claim as my invention is:

1. A device for producing a combustible stoichiometric air-gas mixture comprising:

chamber means having a planar top surface and an inlet for connection to a source of gaseous fuel;

aperture means positioned in the planar top surface of the chamber means in a specific geometric array and wherein the lineal distances $D_s$ between the apertures are identical and about equal to the product of the stoichiometric air-gas ratio R, being of the order of ten, and aperture diameter $d_o$, and whereby said product is multiplied by a constant of proportionality which has a value of 2.42, and said distance $D_s$ being not smaller than about 2.4 $Rd_o$ and not larger by 15% than 2.42 R $d_o$;

said distance $D_s$ being considerably larger than $d_o$ so that gaseous fuel discharging externally from the aperture means produce free turbulent jets which entrain the quantity of air required for stoichiometric combustion of the gaseous fuel and whereby the free turbulent jets coalesce in the stoichiometric demarcation plane which is parallel to the planar top surface of the chamber means and is located a distance above said planar top surface.

2. A device in accordance with claim 1 wherein the aperture means comprises an inner core of three apertures positioned in the apices of an isosceles triangle and whereby the inner core is surrounded by a closed chain of nine apertures.

3. A device in accordance with claim 1 wherein the aperture means comprises an inner core of six apertures positioned at the apices of a hexagon and whereby the inner core is surrounded by a closed hexagonal chain of twelve apertures.

4. A device in accordance with claim 1 comprising a hexagonal chain of six apertures positioned at the apices of a hexagon and surrounding a single aperture.

5. A device in accordance with claim 1 wherein the aperture means consists of a closed chain of apertures positioned on two parallel line segments and whereby there are N apertures positioned on one line segment and N + 1 apertures positioned on the other line segment.

6. A device in accordance with claim 1 wherein the aperture means consists of an inner core of N apertures positioned on one line segment and N − 1 apertures positioned on two outer parallel line segments.

7. A device in accordance with claim 1 wherein the stoichiometric air-gas mixture burns with a blue flame.

8. A device in accordance with claim 1 wherein the top surface of the chamber means is aluminum.

9. A device in accordance with claim 1 wherein the stoichiometric air-gas ratio has a stoichiometry which is greater than unity.

10. A device as in claim 1, whrein the array is comprised of two nested polygons having corners, there being an aperture in each of the corners.

11. A device as in claim 1 and including a heating surface above said planar top surface at a distance therefrom larger than said distance of said stoichiometric plane.

12. A device as in claim 11, wherein said heated surface has a distance from said top surface more than three times the value of the distance of said plane.

13. A device for producing a stoichiometric air-gas mixture for burning of the gas, comprising:

chamber means having a top surface and an inlet for connection to a source of gaseous fuel, air for burning the fuel being permitted to flow above the surface; and aperture means in the planar top surface being arranged in a specific two-dimensional array in which the apertures are spaced from each other, the smallest spacing between two adjacent apertures being about equal to twenty-five times the diameter of the apertures so that free turbulent jets issue from the apertures and coalesce in a plane wherein a stoichiometric gas to oxygen is stablished.

14. A device for producing a stoichiometric air-gas mixture for burning of the gas, comprising:

chamber means having a planar top surface and an inlet for connection to a source of gaseous fuel, air for burning the gaseous fuel being permitted to flow above said surface; and aperture means in the planar top surface being arranged in a specific two-dimensional array wherein the apertures have a lineal distance spacing from each other which is about twentyfive times the diameter of the apertures, whereby as to any one of said apertures, there are at least two of said apertures having said spacing from said one aperture, whereby said two apertures have also said spacing from each other.

* * * * *